US010968615B2

(12) United States Patent
Usher

(10) Patent No.: US 10,968,615 B2
(45) Date of Patent: Apr. 6, 2021

(54) TOILET FLUSHING APPARATUS AND SYSTEM AND METHOD

(71) Applicant: Norman Usher, Inglewood, CA (US)

(72) Inventor: Norman Usher, Inglewood, CA (US)

( * ) Notice: Subject to any disclaimer, the term of this patent is extended or adjusted under 35 U.S.C. 154(b) by 0 days.

(21) Appl. No.: 16/186,531

(22) Filed: Nov. 10, 2018

(65) Prior Publication Data

US 2020/0291629 A1 Sep. 17, 2020

(51) Int. Cl.
*E03D 3/10* (2006.01)
*E03D 3/04* (2006.01)

(52) U.S. Cl.
CPC *E03D 3/10* (2013.01); *E03D 3/04* (2013.01)

(58) Field of Classification Search
CPC ..... E03D 3/10; E03D 3/04
USPC ..... 4/354
See application file for complete search history.

(56) References Cited

U.S. PATENT DOCUMENTS 1,083,974 A * 1/1914 Wulp ..... E03D 3/10 4/362
1,309,230 A * 7/1919 Wells ..... E03D 3/10 4/359
1,358,841 A * 11/1920 Garvey ..... E03D 3/10 4/362
1,383,273 A * 6/1921 Klahn ..... E03D 3/10 4/356
3,029,443 A * 4/1962 Naccarato ..... E03D 3/10 4/362
5,046,201 A 9/1991 Steinhardt et al.
6,929,288 B2 * 8/2005 Usui ..... F02M 55/025 285/122.1
9,416,523 B2 * 8/2016 Usher ..... E03D 3/02

OTHER PUBLICATIONS

Wikipedia Exerpt About Flushometer.

* cited by examiner

*Primary Examiner* — Huyen D Le
(74) *Attorney, Agent, or Firm* — Lawrence S. Cohen

(57) ABSTRACT

A system that uses a flushometer for residential toilets in which adjustments and additions are made in order to allow the flushometer to operate correctly. There is an immediate flush water assembly that provides enough water, under pressure to pas through the flushometer. Also, a check valve can be used to isolate the pressurized water stored for the flush so as to reduce effect on the residential plumbing system and to provide control over flush and recharge. Also, a reduced diameter supply piping portion allows for additional control.

22 Claims, 21 Drawing Sheets

TOILET FLUSHING APPARATUS AND SYSTEM AND METHOD

FIELD

The present application relates to plumbing specifically to plumbing apparatus for and including residential toilets.

BACKGROUND OF THE INVENTION

In most cases, the main pipeline from the street to a home is either ¾ or 1 inch in diameter, supply branches use ¾-inch-diameter pipe, and pipes for individual components are ½ inch or in some homes ⅜ inch. Homes and other noncommercial properties usually have gravity toilets connected to the ½ inch or ⅜ inch component pipes. These gravity toilets use a water closet or tank that fills with, for example, 12 inches of water before each flushing. The pressure resulting from the force of gravity acting on this column of water moves water into the toilet bowl when flushed. Standard water pressure to a residence is, for example in Los Angeles, Calif., 55 psi. A high safety level is at 80 psi.

Many commercial buildings have water supply pipes of at least 1 inch diameter. The water from such pipes flows through a flushometer valve, or high flow flush valve, directly into a toilet bowl and generated a better flushing than does a gravity toilet. When the flushometer is activated, it releases a metered amount of water into the toilet, then closes. The single flush from the flushometer theoretically wastes less water per flush than a typical tank system because it cleanses the bowl with a metered lower-volume, higher-pressure stream. An exemplary single flush will last for 3-5 seconds. There is also no need for a tank, and therefore no refilling time between flushes. The drawback to installing a flushometer is that it is not compatible with all plumbing systems. The water piping itself for a flushometer has to allow a water pressure of at least 20 to 25 psi for the flushometer to function properly, which is not usually possible with the ¾-inch piping found in most homes. This is due to the fact that the available water pressure decreases rapidly as the diameter of the water supply pipe decreases. A toilet with a flushometer receiving water directly from a ½ inch or ⅜ inch diameter water supply pipe flushes poorly often resulting in stoppages that must be cleaned out. A system has been developed to allow water to flow vigorously enough through a flushometer valve connected to a small diameter home water supply pipe to provide a good flushing. Such a system is described in U.S. Pat. No. 9,416,523 in which a water storage apparatus is provided by enlarged diameter pipes lying close to the flushometer valve; the pipes having an exemplary diameter of 1.5 inches. While this system provides a larger amount of water upon flushing than is normally available in a residential flush system, there are operational shortcomings. One such shortcoming is that upon activating the flush there is immediate flow of the large volume of water in the enlarged diameter pipes as a result of which there is caused a severe drop in water pressure upstream from the toilet. This causes an immediate, but temporary decrease in water flow to nearby plumbing fixtures (the terms "fixture" and "component" are used synonymously in this description). This interruption effects cold water only—which is presumed to be the supply used for flushing. Interruptions in showers, baths, dish or clothes washing are not pleasant experiences, not only due to drop in flow, but also in sudden temporary increase in water temperature if there is also hot water flowing. Providing the good flushing such as of a commercial toilet equipped with a flushometer valve without upstream water pressure loss or intermittent or cyclical pressure variations to the upstream plumbing would be of value in residential plumbing systems that have smaller pipe sizes than do the commercial plumbing systems that normally use a flushometer.

SUMMARY OF THE INVENTION

In one embodiment of the invention a pressurized flush water immediate supply assembly of the flushing system comprises both an enlarged piping portion as in the prior art (called herein flush valve adapter piping or adapter piping) and also a pressurized water storage apparatus in an exemplary form as an accumulator tank. The flush valve adapter piping and the pressurized water storage apparatus together define a pressurized flush water immediate supply assembly. This then provides sufficient water supply and pressure to accomplish the flushing process through a flushometer, so that the undesirable immediate demand upstream is mitigated. Thus, at flushing, a larger volume of water under pressure is available to be released through the flushometer. In an embodiment, one type of accumulator tank is a bladder type pressurized storage vessel designed to hold water under pressure. The accumulator tank provides additional water storage under pressure to assist toilet flushing volume in meeting total demand in volume and pressure to flush properly when a flushometer is used. It therefore reduces the impact of demand for water from the upstream plumbing and reduces the pressure drop on nearby fixtures (also called components) in residential plumbing systems.

Nevertheless, it has been determined that other pressure transients on the upstream plumbing can occur by use of a pressurized water storage apparatus, sometimes called "water hammer" or "back flow" or "back pressure".

To provide enhanced control of the flushing and recharging operation and to avoid upstream anomalies, in one embodiment of the invention a check valve connects the residential component supply plumbing to the flush water immediate supply assembly. When the system is at the ready to flush, the flush water immediate supply assembly is under pressure, ready for a flush and the check valve is closed. When the flushometer is activated the pressure created by the stored water in the flush water immediate supply assembly reduces during the exiting of water through the flushometer, a reduced pressure is reached that then causes the check valve to open thereby allowing re-filling the flush water immediate supply assembly to become available for another flush actuation. As the flush water immediate supply assembly is filled its pressure increases to a point that the check valve closes. Then the system is ready for a new flush action. The check valve tends to prevent and block pressure transients from passing upstream.

In a further embodiment, it has been determined that even further isolation of the upstream plumbing from the flushometer type flushing system can be accomplished by putting in a reduced diameter length of piping between the residential component supply plumbing and the entry to the check valve. A reduction of ⅛ inch from the diameter of the residential component supply plumbing has been found effective for this purpose.

It can be understood that the flush water immediate supply assembly can be accomplished in any way that the required volume of water for accomplishing the flush is stored under pressure sufficiently adjacent to the flushometer valve to have the necessary flow amount and pressure when the flushometer valve is activated to accomplish the flush action.

This can be a single pressurized container of water or a plurality of containers in pressurized communication. It is also understood that the pressurization needs to be available as a recharging for subsequent flushing. The pressure for recharging is described as coming from the residential plumbing water supply and the resulting recharged pressure is at whatever pressure is available from the residential plumbing water supply. That pressure can vary based on a number of variables. One of the variables is the pressure provided by the local water supply system. Another is the maximum pressure allowed into the residence by a pressure regulator which is typically required to be used and in any case recommended in order to protect the residential plumbing and fixtures. Other variables can be found in the particular condition of the residential plumbing system.

DETAILED DESCRIPTION

Figure 1:
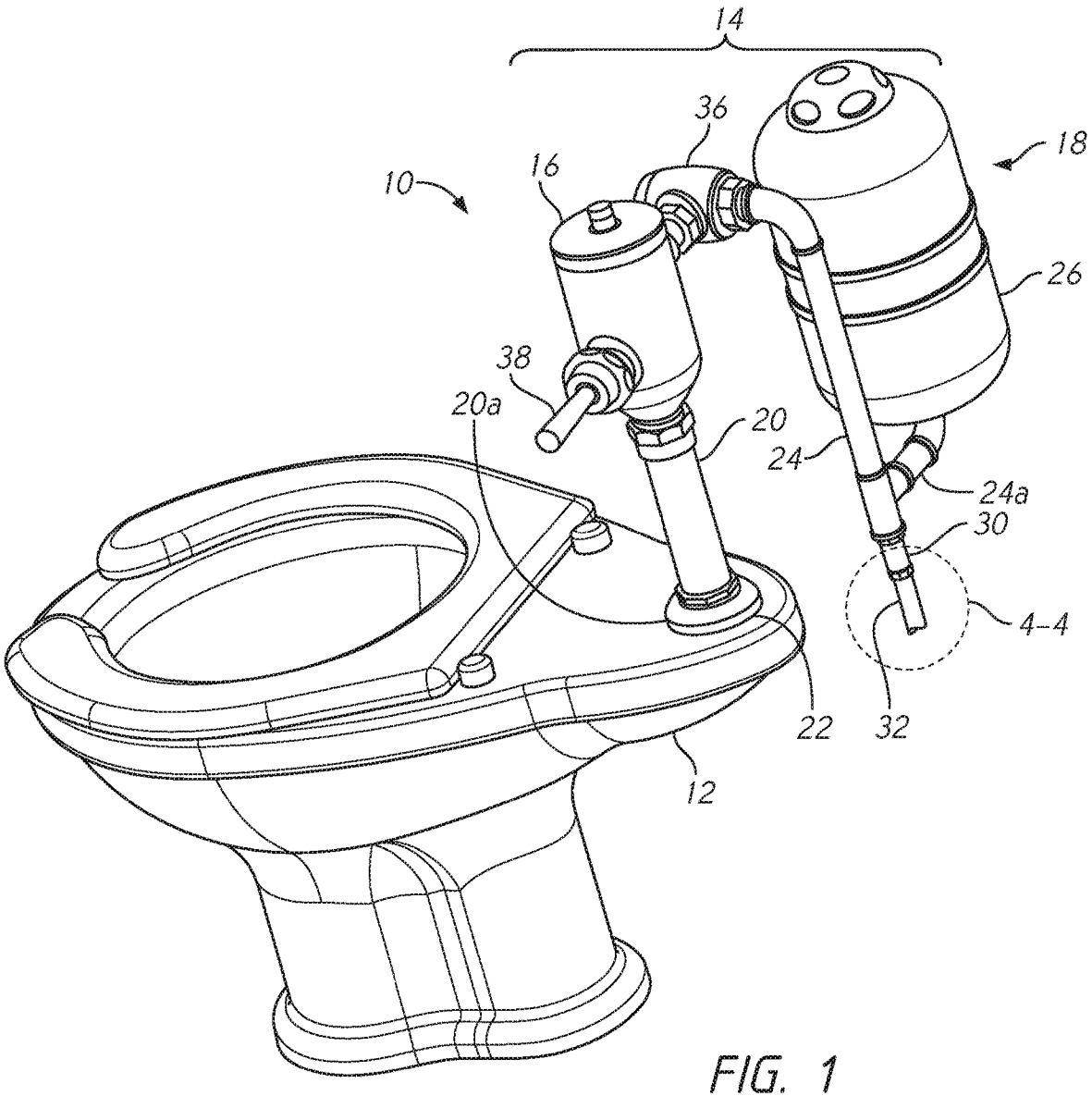
FIG. 1 is a perspective view of a toilet assembly incorporating high flow flush assembly

Reference is made to U.S. Pat. No. 9,416,523 the entire content of which is incorporated herein by reference. It is a goal and incorporated in both Federal and State regulations to have more exact and reduced amount of flush water for toilets. Flushometer valves provide a strong and highly metered flow of water. Flushometer valves are designed for commercial applications in which larger (than residential) supply plumbing is used. The current design of flushometer valves is enabled for use in commercial plumbing systems. Enabling use of the current flushometer valve designs for residential plumbing systems can accomplish the goals for reducing flush water in residential toilets.

The system described in the '523 patent enables the use of a flushometer (also referred to as a flushometer valve or flush valve) in a residential plumbing system that employs a small diameter water supply by providing a water storage volume comprising enlarged diameter piping lying close to the flushometer. The immediate flushing supply source in the form of enlarged piping stores more water than would the normal smaller piping so that on flushing a larger volume of water is immediately available through the flushometer valve into the fluid connector connected to a toilet inlet. Thus, the system provides a higher volume of water to be available through a flushometer valve even though a large diameter pipe is not available from the basic water supply system as is available in commercial systems. Therefore, the immediate flushing supply source provides a larger volume of water immediately available for the flushometer flushing in a residential system. However, the system in the '523 patent is deficient because upon activation of the flushometer valve, there is an instantaneous demand on the upstream small diameter residential supply system, which causes pressure drop of flow at nearby fixtures (also referred to as components). It also can be deficient in not providing the immediate continuity of flow volume at the rate required in a flushometer valve flushing cycle.

In typical present-day residential water systems, the main pipeline from the street is either ¾ or 1 inch in diameter, supply branches use ¾ inch diameter pipe and pipes for individual components are commonly ½ inch diameter. In older homes, the supply branch may be ½ inch and the pipes to individual components may be ⅜ inch diameter. The piping to the particular individual component in this description meaning the toilet, is referred to as the residential component supply source.

The presently described embodiments provide improved functioning of the use of a flushometer equipped toilet flushing system that is connected to residential component supply source. In addition to improved interaction with the flushometer valve operation by a well regulated flow immediately available to the flushometer undesirable effects to the residential water supply source are mitigated. There are a plurality of such undesirable effects, and as will be appreciated from the following descriptions, there are corresponding different embodiments for compensating for those undesirable effects The present invention is in the realization of the problems incurred by the system described in U.S. Pat. No. 9,416,523 wherein the solution to the problem is recognized in this description to enlarge the immediate supply of pressurized flush water volume maintained at the necessary pressure for access by the flushometer by an additional and pressurized water supply source to result in an enlarged pressurized immediate supply source with sufficient volume of water under pressure to fully operate a flushometer valve. This then provides an efficient flush operation while thereby mitigating the demand on the supply source during the course of the flushing.

However, the solution to the immediate problem of sharp demand on source water results in other complications which themselves are mitigated by the embodiments as described herein. It is further appreciated that the flush water immediate supply assembly is in its general concept a combination of a volume of water under such pressure and sufficiently closely adjacent to the flushometer valve as to serve as sufficient water volume and at sufficient pressure to the flushometer valve for correct operation of the flushometer valve, referred to herein as the pressurized immediately available water supply, made available by a pressurized flush water immediate water supply assembly (sometimes referred to as an immediate supply assembly). The pressurized flush water immediate supply assembly combined with the flushometer is called the high flow flush assembly. In this embodiment, as flushing is started by actuation of the flushometer valve, and a large demand is made, the pressurized flush water immediate supply assembly meets that demand during the most demanding flushing time through the flushometer. The effect is to provide a regulated flow to the flushometer valve and also to greatly reduce the sharp flow demand upstream on the supply source system. It is the added volume from the pressurized water storage apparatus that implements the reduced demand on the supply system.

In one embodiment of the present invention the pressurized immediate flush water supply is enlarged by providing additional water storage in a pressurized water storage apparatus, exemplary form being an accumulator tank. In one embodiment it is located in combination with the enlarged piping near the flushometer as exemplified in the '523 patent, herein called the flush valve adapter piping (also called the adapter piping) although the flush valve adapter piping can take on embodiments different from that shown in the '523 patent. The combination of flush valve adapter piping and the pressurized water storage apparatus is an embodiment of the pressurized flush water immediate supply assembly.

Nevertheless, as the flow from the pressurized water storage apparatus initially occurs some undesirable upstream effect occurs referred to as "back flow" or "back pressure" or "water hammer". That gives rise to a further embodiment in which a check valve is in place at the supply system source point. The check valve is closed when the high flow flush assembly is charged ready for flushing. and, at the instantaneous onset of flushing the check valve remains closed thereby avoiding undesirable upstream effect caused by the immediate release. As the flushing proceeds, and the pressure ahead of the check valve drops to its open specified pressure difference it opens and begins the refill process.

In a yet further embodiment, immediately upstream of the check valve a reduced diameter length of pipe is installed. That is, between the check valve and the residential component supply source, a reduced diameter length of piping is installed. That reduced length of piping cuts the rate of flow when the check valve opens thereby more fully enhancing avoidance of a demand that would cause an instantaneous pressure drop at nearby components and other undesirable effects on the residential component supply source.

While each of the foregoing embodiments has its own contribution to implementing flushometer application in residential toilet operation, it is further appreciated that the embodiments employed together collectively enhance effective operation of flushometer flushing of residential toilets so that the use of a pressurized flush water supply assembly along with a check valve is advantageous, and the additional use of a reduced diameter length of piping incoming to the check valve is further advantageous.

In the following descriptions it should be recognized that plumbing dimensions and quantities are designated but in practice those designations are inexact. For that reason some designations are considered "nominal" and are used as such although persons skilled in the art understand that in applications the amount can vary. Exemplary of nominal amounts are the flush volumes designated in regulations and in supplied equipment as the flush volume in gallons (US liquid gallons) per flush (gpf) also showing a conversion to liters:

1.6 gpf converted to 6.057 liters;
1.28 gpf, converted to 4.845 liters;
1.06 gpf, converted to 4.012 liters
1 gpf, converted to 3.785;

The liter conversion quantities being arithmetic and not intended to designate an accuracy in the liter measurement used in plumbing practice.

Similarly, the term "about" for amounts such a water volume, pipe size and other dimensions/measurements used herein, is used to refer to a level of variation understood by persons skilled in the art of plumbing systems and equipment.

FIGS. 1, 2, 3, 4 and 5A and 5B show an exemplary embodiment of a complete toilet assembly 10 in which a toilet bowl 12 is combined with a high flow flush assembly 14 in order to provide a resulting high flush or flushometer toilet adapted for application in a residential plumbing system. The high flow flush assembly 14 comprises in combination flushometer 16, pressurized flush water immediate supply assembly 18 and toilet connection pipe 20 which can function as a vacuum breaker tail piece in exemplary size as 1½ inch, connecting the flushometer 16 to a toilet inlet 22 of the toilet bowl 12. The pressurized flush water immediate supply assembly 18 comprises in this embodiment, two parts in fluid communication, one part being a flush valve adaptor piping (also called adapter piping) 24, and the other part being a pressurized water storage apparatus 26 exemplary of which is an accumulator tank.

Figure 2:
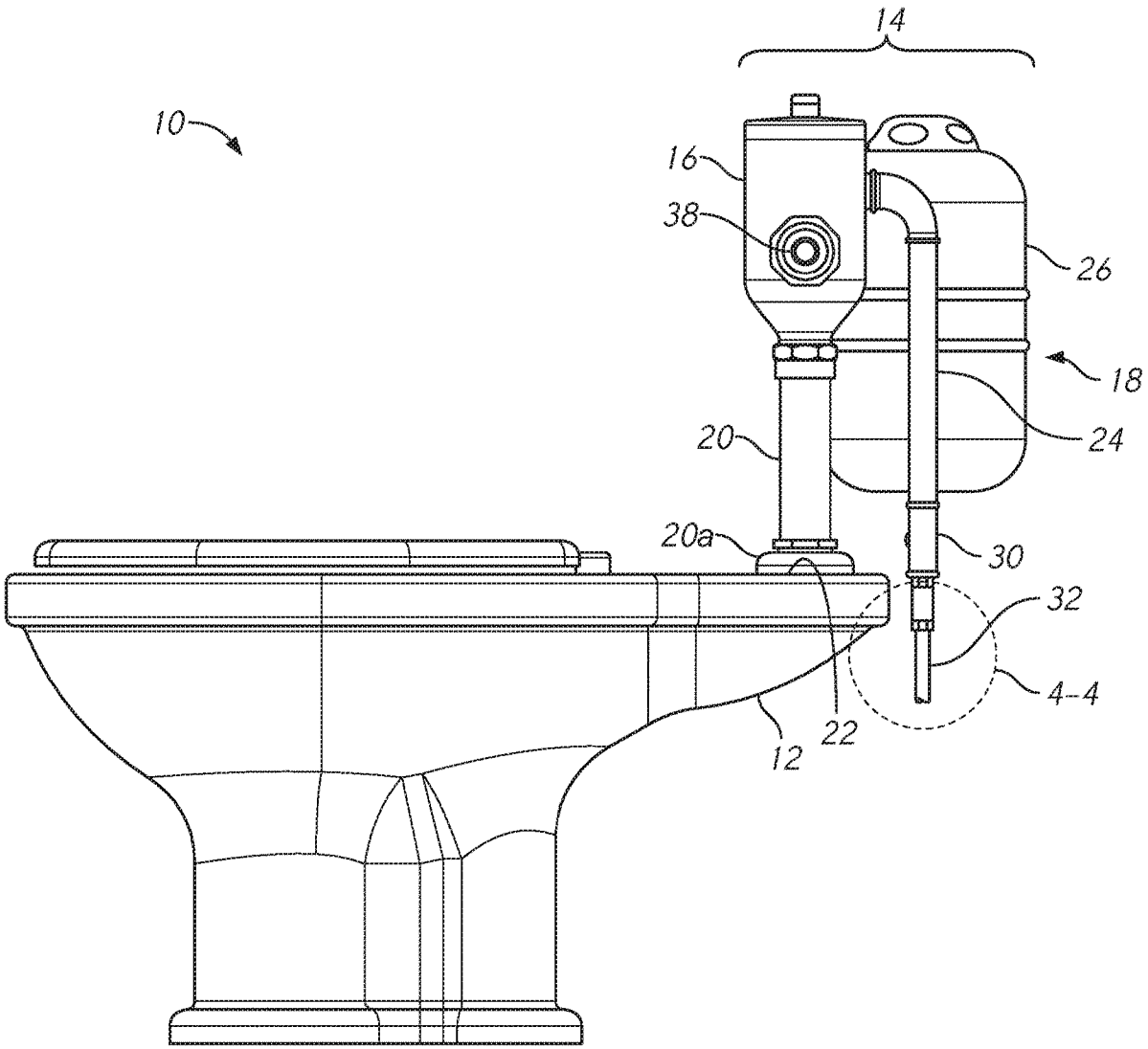
FIG. 2 is a side view of the embodiment of FIG. 1.
Figure 3:
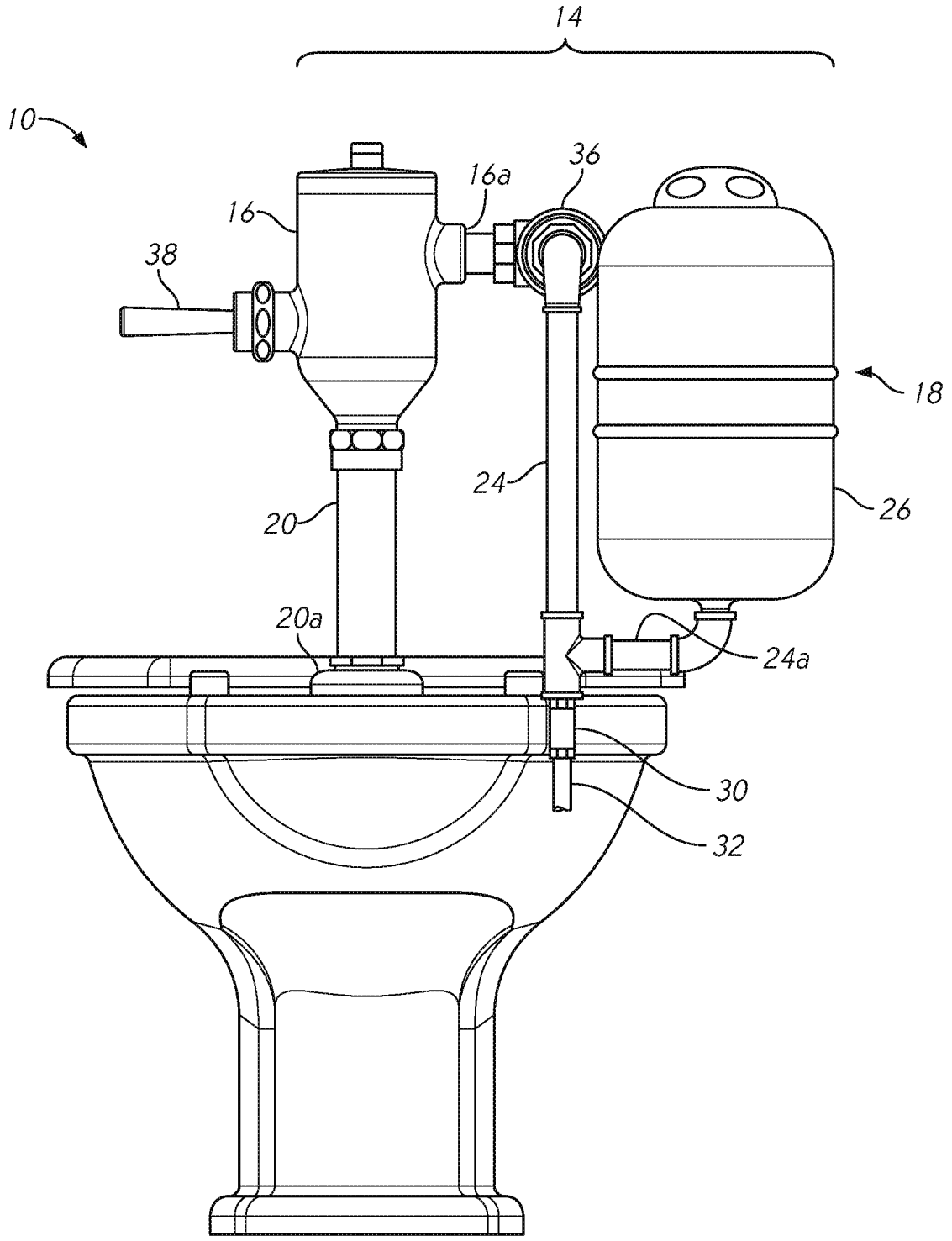
FIG. 3 is a rear view of the embodiment of FIG. 1.

In a further exemplary embodiment the high flow flush assembly 14 is connected to residential component supply plumbing 28 through a check valve 30 exemplary of which is a spring check valve. The encircled 4-4 of FIGS. 1 and 2 is more fully seen in FIG. 4. The check valve specification is selected to be open shortly after flush has begun through the flushometer and to close when re-charge of the pressurized flush water immediate supply assembly has completed. Those events are determined by the selected specification of the opening and closing pressure difference of the check valve.

Figure 4:
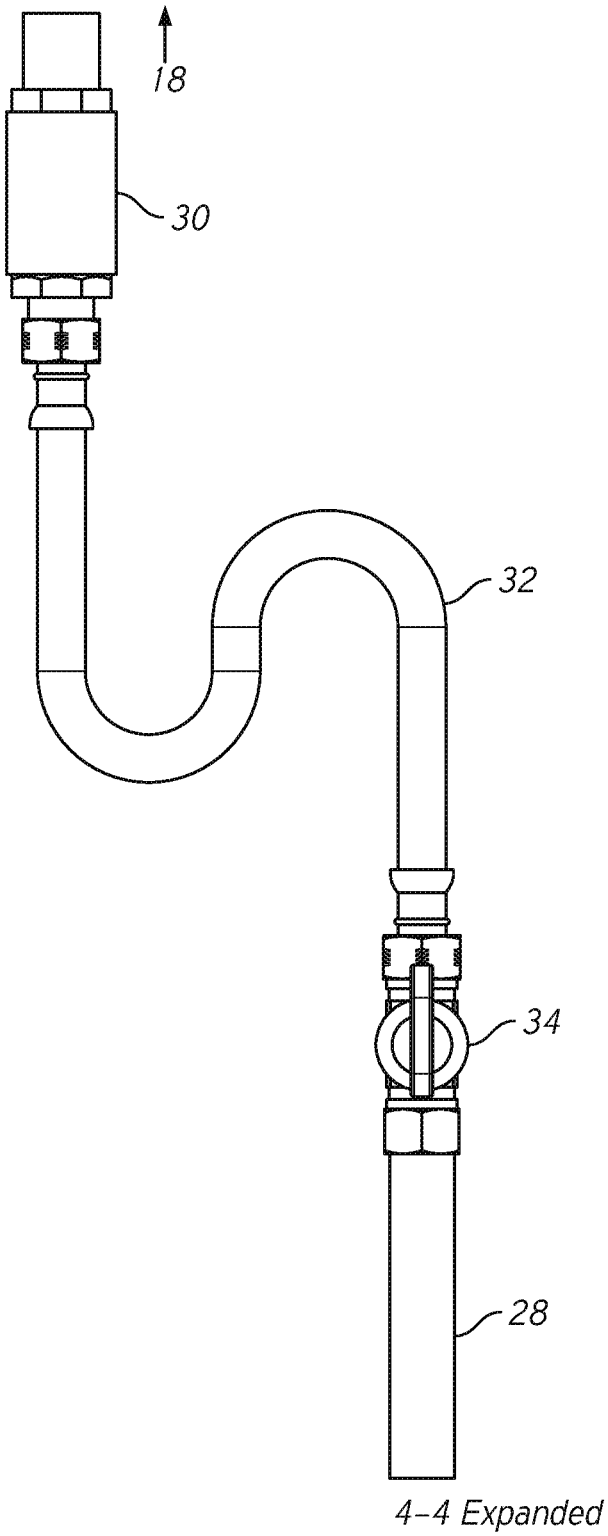
FIG. 4 is a view of an embodiment of residential plumbing as attached to the toilet assembly through a check valve.

In an embodiment as shown in FIG. 4, connected directly for water intake to the check valve 30 is a source connector pipe 32 of reduced size relative to the residential component supply plumbing 28 at which is a normally installed shut off valve 34. The source connector pipe 32 would have exemplary size of ⅜ inch in the embodiment of the residential component supply plumbing 28 having a size of ½ inch. That is a ⅛ inch size reduction is considered sufficient for the desired flow rate reduction. That size reduction has the effect when the check valve 30 is open, of restricting the flow rate to avoid reduced pressure drop at nearby components. This works together with the added volume provided by the pressurized water storage apparatus 26.

An exemplary flushometer is a TOTO TMT1NNC Series Non-Hold Open Toilet Flushometer Valve—1.6 gpf, Model TMT1NNC—32 (1½" Vacuum breaker) which is constructed to connect to a 1 inch water supply and specifies a supply water pressure at 15 psi-100 psi (noting that water pressures over 80 psi are not recommended for most plumbing fixtures).

Another exemplary flushometer which is specified for a toilet bowl operative with 1.28 gpf, is a TOTO TMT1LN Series Non-Hold Open High Efficiency Toilet Flushometer Valve—1.28 gpf; Model TMT1LN32 #CP (1½" Vacuum breaker) which is connected to a 1 inch water supply and specifies a supply water pressure of 35 psi-100 psi and with a minimum flow rate of 23 gpm (noting that water pressures over 80 psi are not recommended for most plumbing fixtures)

An exemplary check valve is a WATTS Series LF600, size (DN).

Figure 5B:
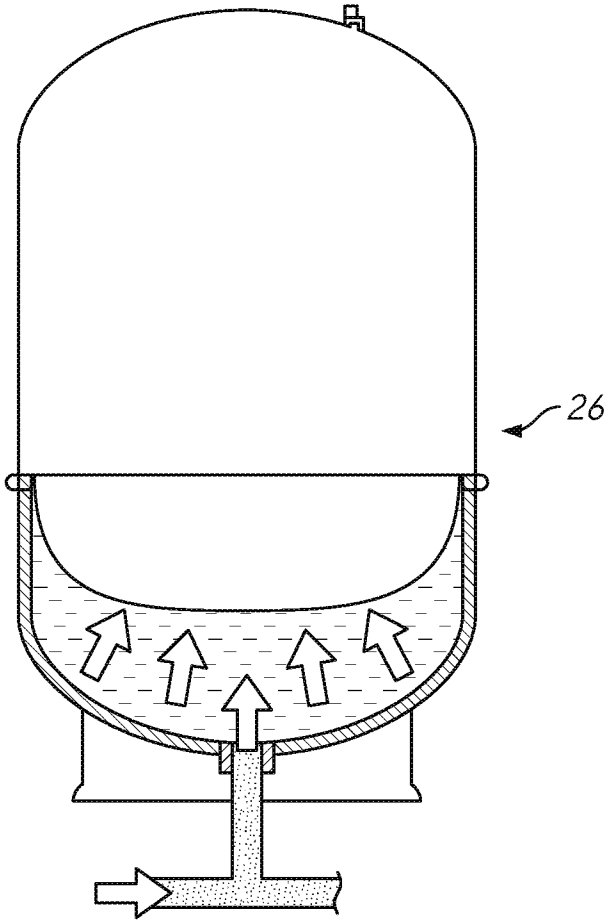
FIGS. 5A and B show an exemplary type of accumulator tank in its filled condition (5A) and in its unfilled and filling condition (5B).
Figure 5A:
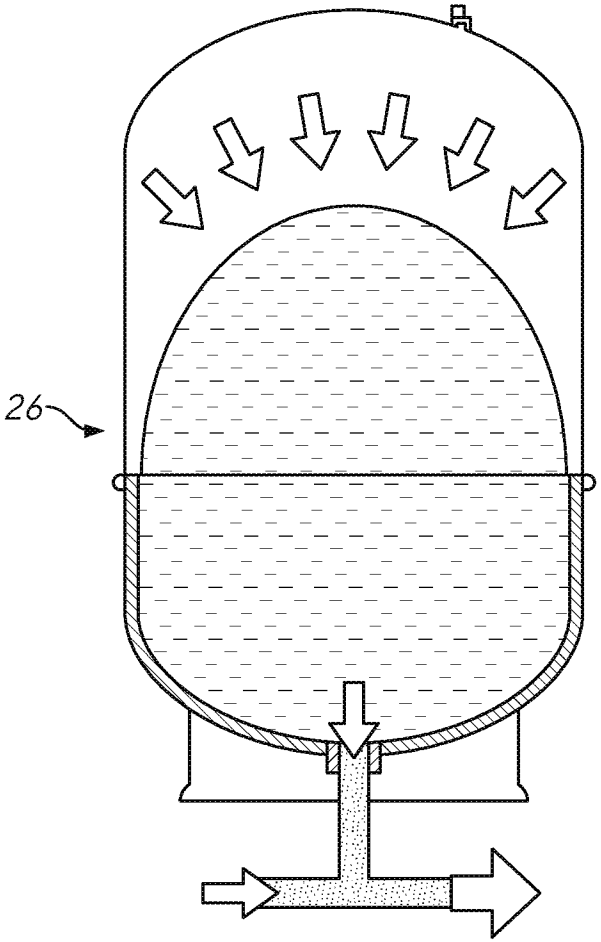

An exemplary pressurized water storage tank is an accumulator tank sold by Challis Booster, viewable at challisboost.com. FIGS. 5A and 5B show the exemplary accumulator tank 26 as sold by Challis Booster. As illustrated in FIG. 5A, the bladder is extended to provide a volume of water which is under pressure from the pressurized air at the top and the water is flowing out. FIG. 5B shows the status when the water has been pushed out and recharging is in effect from a water source.

A person skilled in the art will know what specifications for flushometer valves, pressurized tank products, check valves and other parts will be suitable for particular installations.

A flushometer valve opens for flow into the toilet at a rate and predetermined volume determined by its particular design, to properly operate the toilet. Exemplary of this operation is a brief flushing action of from about 3-5 seconds that will operate the flushing action of the toilet. For its operation, the flushometer valve provides a specified volume of water sufficient to accomplish the flushing of the toilet, in a very short time requiring a maintained pressure available from the residential plumbing system. That pressure is typically considered to be in a range of a minimum of about 25 psi to about a safety limit of 80 psi, about 50 to 75 psi being considered a generally satisfactory requirement for a high efficiency toilet. Water conservation is tending to limit flow per flush requirements. Flushometer valves are now available and more so in future are to be available for a volume per flush of 1.6 gpf and 1.28 gpf and 1.06 gpf as regulated by Federal law and some States (California for example). The Federal law of 1.6 gpf for flushometer toilets is the Energy Policy Act of 1992. The California law of 1.28 gpf for new installations came into effect in 2016. Proposals have been made to go as low as 1.06 gpf, or nominally 1 gpf.

In this description, therefore, reference to pressurized water supply available for flushing refers to the pressure available from the residential component supply plumbing that serves as the source of the water.

As noted above, the pressurized flush water immediate supply assembly 18 has two parts. One part is the flush valve adapter piping 24 (also called the adapter piping) which is an enlarged piping relative to the residential supply pipe size and in one embodiment can be attached to the flushometer 16 at its inlet 16*a* by any normally understood means of attachment, the present example being an adapter of the type double slip tail piece. As would be obvious to one of ordinary skill in the art other adaptors could be used or the flush valve adapter piping 24 could be connected directly to flushometer 16 depending on the needs of the particular installation.

Exemplary size of the adapter piping 24 being ¾ inch and preferably 1 inch. The adapter piping 24 is closely adjacent to entry of the flushometer 16 and may contain about 1 liter of water. The other part is the pressurized water storage apparatus 26, exemplary of which is accumulator tank 26. Accumulator tanks are well known and are available in a wide range of specifications as well as being of technologies as bladder type, diaphragm type and piston type. It is considered that for the present embodiments, a bladder type accumulator tank, is suitable, the diagram of which is in FIGS. 5A and 5B as noted above. The accumulator tank acts as a pressure buffer ensuring a smooth flow and a larger volume of water on demand when the toilet is flushed; providing continuation of requisite pressure through the flushing cycle. In the case of a direct connection to the residential water supply this will create undesirable pressure drop at close components in the residential system. An exemplary accumulator tank is designated at 5 liters. At the status of being ready for flushing, the pressurized flush water immediate supply assembly 18 is full and under pressure created by its having been filled from the residential supply system. The check valve 30 is closed by its pressure differential operating to the closed position. At the ready to flush condition, the pressurized water storage apparatus 26 is in the ready condition at the incoming pressure from the residential component supply plumbing to which it has been recharged in the prior step and. the check valve 30 is closed ready for a flush sequence to occur.

Upon use water flow is initiated through the system by actuating the flushometer 16. High pressure water from the pressurized flush water immediate supply assembly 18 flows through the flush valve inlet 16*a*, through the flushometer 16, the toilet inlet 22, into the toilet bowl 12 effectuating the toilet flush. Thus, water flowing out of the adapter piping 24 is replaced by water flowing from the pressurized water storage apparatus 26. Despite the pressure provided by the pressurized water storage apparatus 26, at the flushing there is a pressure drop that causes the check valve 30 to open which commences refilling the pressurized flush water immediate supply assembly 18, in effect recharging the pressurized water storage apparatus 26. Normally the adapter piping 24 will remain full through to and at the end of the flushing cycle, while the pressurized water storage apparatus 26 will have a decrease in water volume and pressure which is subject to the refill process. That decrease in pressure will cause opening of the check valve 30 which will then re-charge the pressurized flush water immediate supply assembly 18 which means to the most effect refilling the pressurized water storage apparatus 26. An exemplary system and operation will re-charge itself in less than 15 seconds to return the ready to flush condition. In the embodiment absent a check valve, the pressure in the pressurized flush water immediate supply assembly will become equal to the residential incoming pressure at which point the recharging will be complete and flow will cease.

In the embodiment that employs a check valve, the opening and closing of the check valve controls the flow from the residential component supply 28 into the immediate supply assembly 18. Thus, water flowing through the flushometer 16 is replaced when the check valve 30 opens, by water flowing from the residential component supply plumbing 28. Exemplary spring check valve 30 when closed prevents back flow of water from the immediate supply assembly 18 which would be caused by the pressure in the pressurized water storage apparatus 26 exceeding the allowed pressure differential between the input and output of the check valve 30. Check valves have a tolerance range of operation called the cracking pressure or opening pressure, which is a differential of pressure between the inlet and outlet of the check valve. Subject to the operation as controlled by the cracking pressure, it can be understood that the check valve 30 will be closed when the pressure of the immediate supply assembly 18 reaches a pressure that will actuate closing the check valve 30. Then when the flushometer 16 activates, the pressure will drop so as to cause the check valve 30 to open and recharge the immediate supply assembly 18 which is kept under pressure because of the pressurized water storage apparatus 26.

In one embodiment the residential component supply plumbing 28 has a diameter of ½ inch and carries water at a pressure as available from the residential source, a range of about 50 psi to about 75 psi being common. For purposes of this description, this pressure is defined as the residential supply pressure. The flush valve adapter piping 24 has a diameter of at least ¾ inch preferably about 1 inch, and both the flush valve adapter piping 24 and the pressurized water storage apparatus 26 store water at a pressure at the ready to flush status. As would be obvious to one of ordinary skill in the art higher water storage pressures would be possible with little to no change in the system up to the pressure available from the residential supply plumbing.

In one embodiment the pressurized water storage apparatus 26 is an at least 5 liter accumulator tank connected to the flush valve adapter piping 24 by a short section of connector piping 24*a* similar in diameter to the flush valve adapter piping 24 so as to contribute to the flush water volume collected for use. In the embodiment shown pressurized water storage apparatus 26 is connected to flush valve adapter piping 24 near its connection to the residential water supply source 28 and check valve 30.

As would be obvious to one of ordinary skill in the art other pressurized water storage apparatuses of varying sizes could be used and the pressurized water storage apparatus could be connected at any location along the flush valve adapter piping, although where it is most distant from the flushometer valve is best so as to have it push the water in the adapter piping through the flushometer. As would be obvious to one of ordinary skill in the art it would also be possible to add extra pressurized water storage apparatuses along flush valve adapter piping.

In one embodiment the flushing action of the flushometer 16 is controlled by a handle 38 which operates to initiate the flushing action. As would be obvious to one of ordinary skill in the art other flush initiating mechanisms, such as a motion sensor, and associated fluid connecters are possible.

Furthermore, toilet connector pipe 20 can comprise a vacuum breaker tail piece connected to a spud coupling 20*a* at the toilet inlet 22.

The following descriptions relate to embodiments in which a pressurized flush water immediate supply system, in its embodiment as two components, an adapter piping and a pressurized water storage apparatus are in one embodiment hung on a wall and in another embodiment installed inside a wall. The part numbering is a system that uses the same two digits for common previously identified parts but using a three digit 100 series (FIGS. 6-12) and 200 series (FIGS. 13-21, while new parts will have new numbers in the series.

Figure 6:
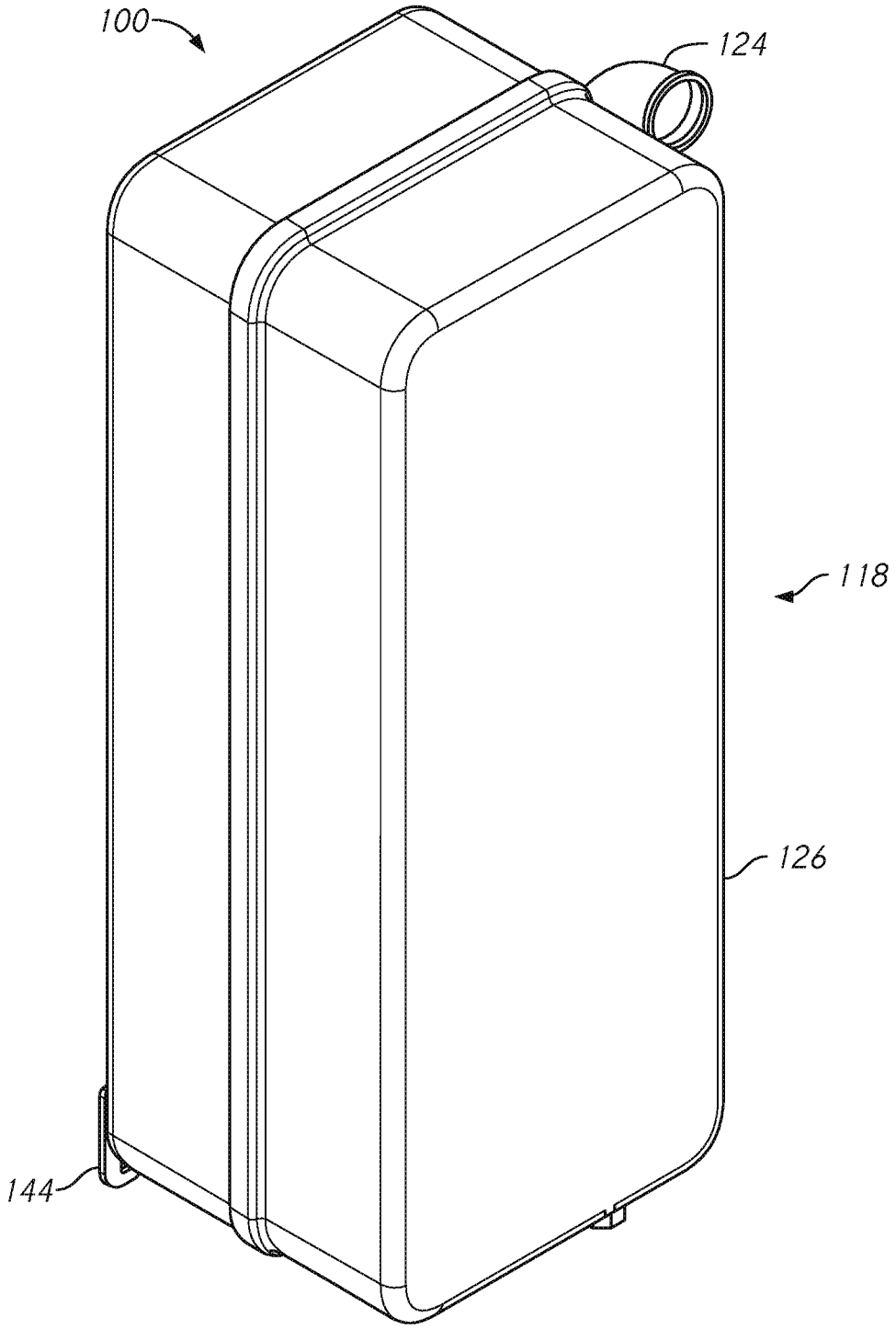
FIG. 6 is a perspective view of an alternative embodiment of the flushometer immediate supply assembly for installation on a wall.
Figure 7:
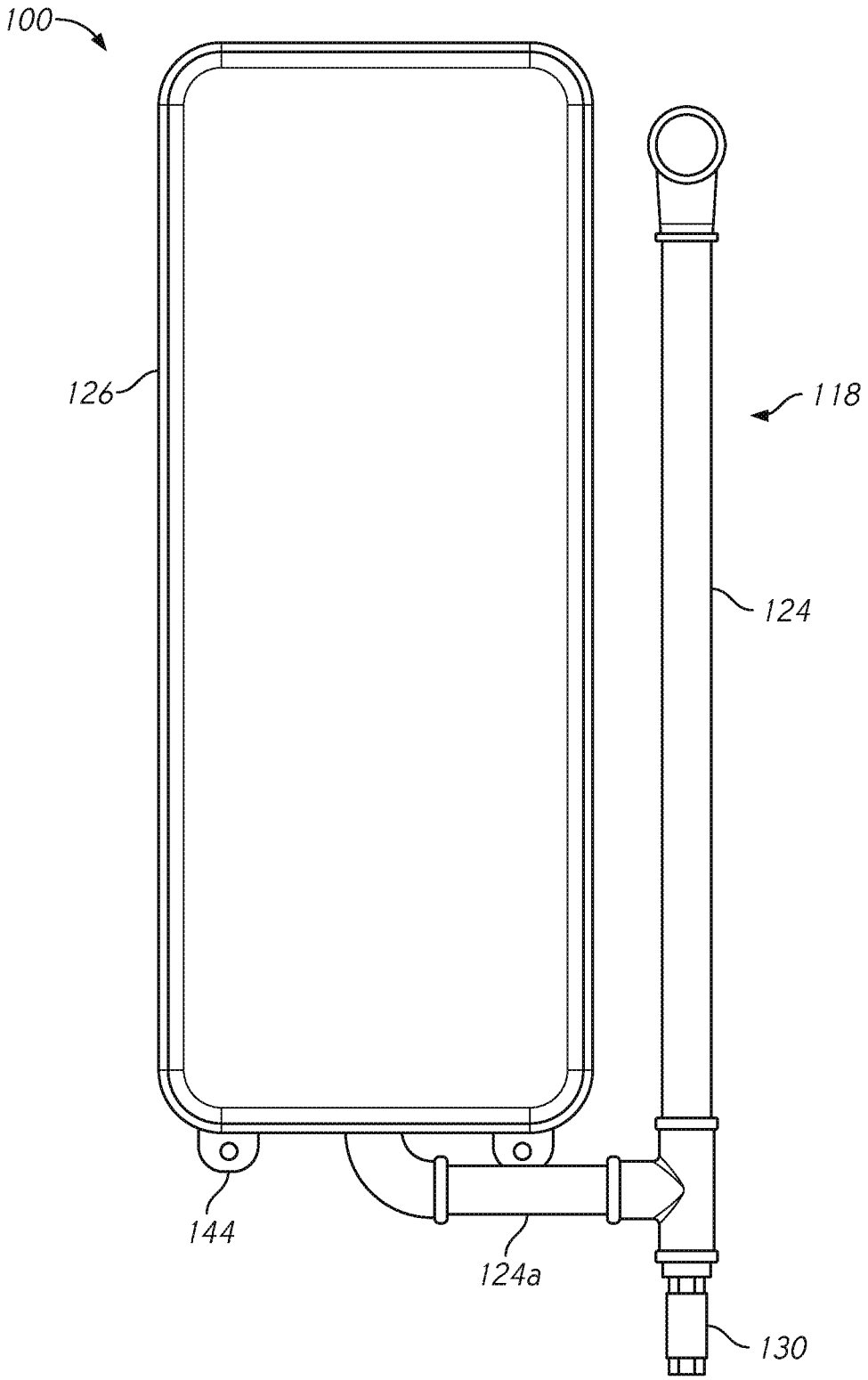
FIG. 7 is a front view of the embodiment of FIG. 6.
Figure 8:
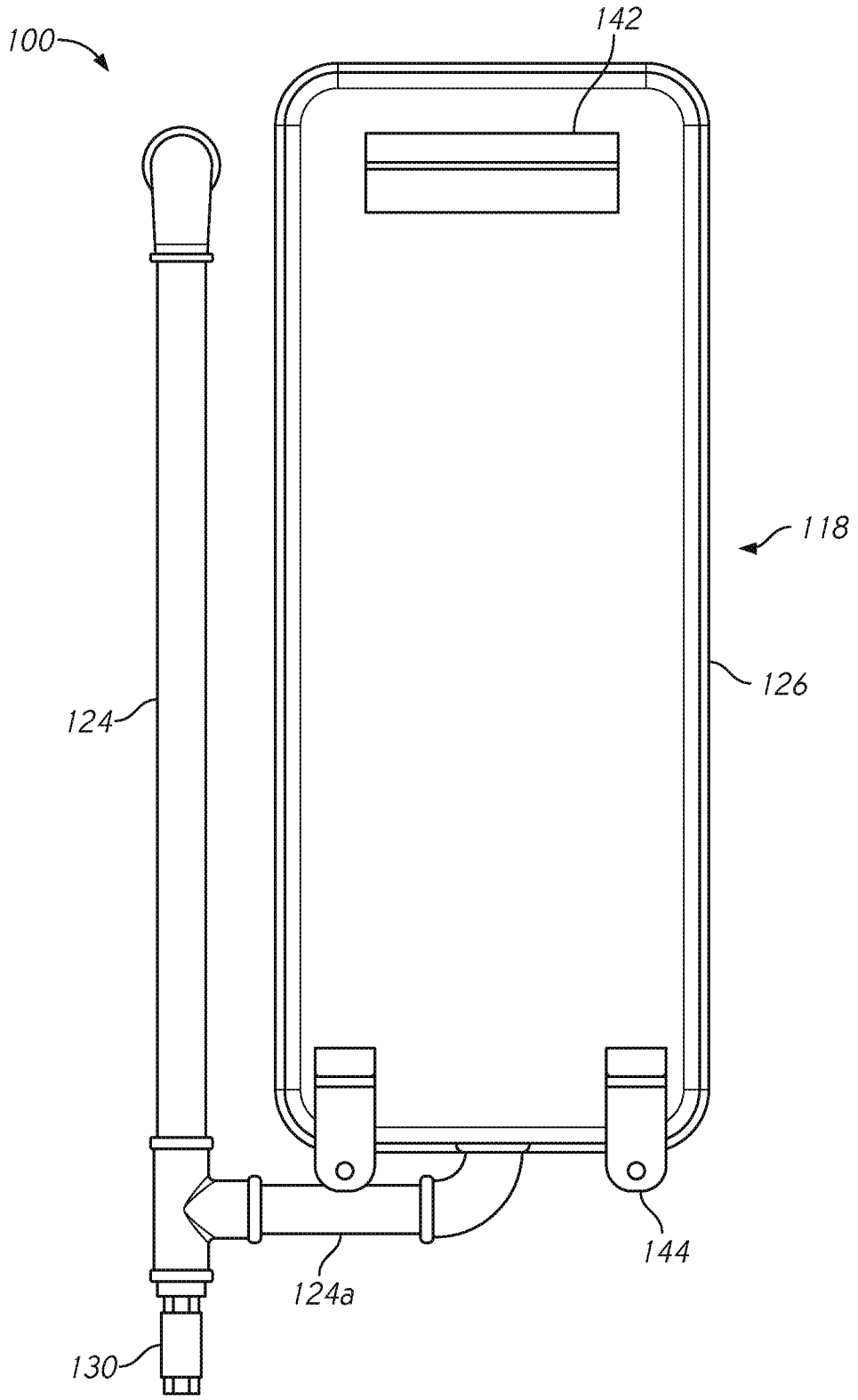
FIG. 8 is a back view of the embodiment of FIG. 6.
Figure 9:
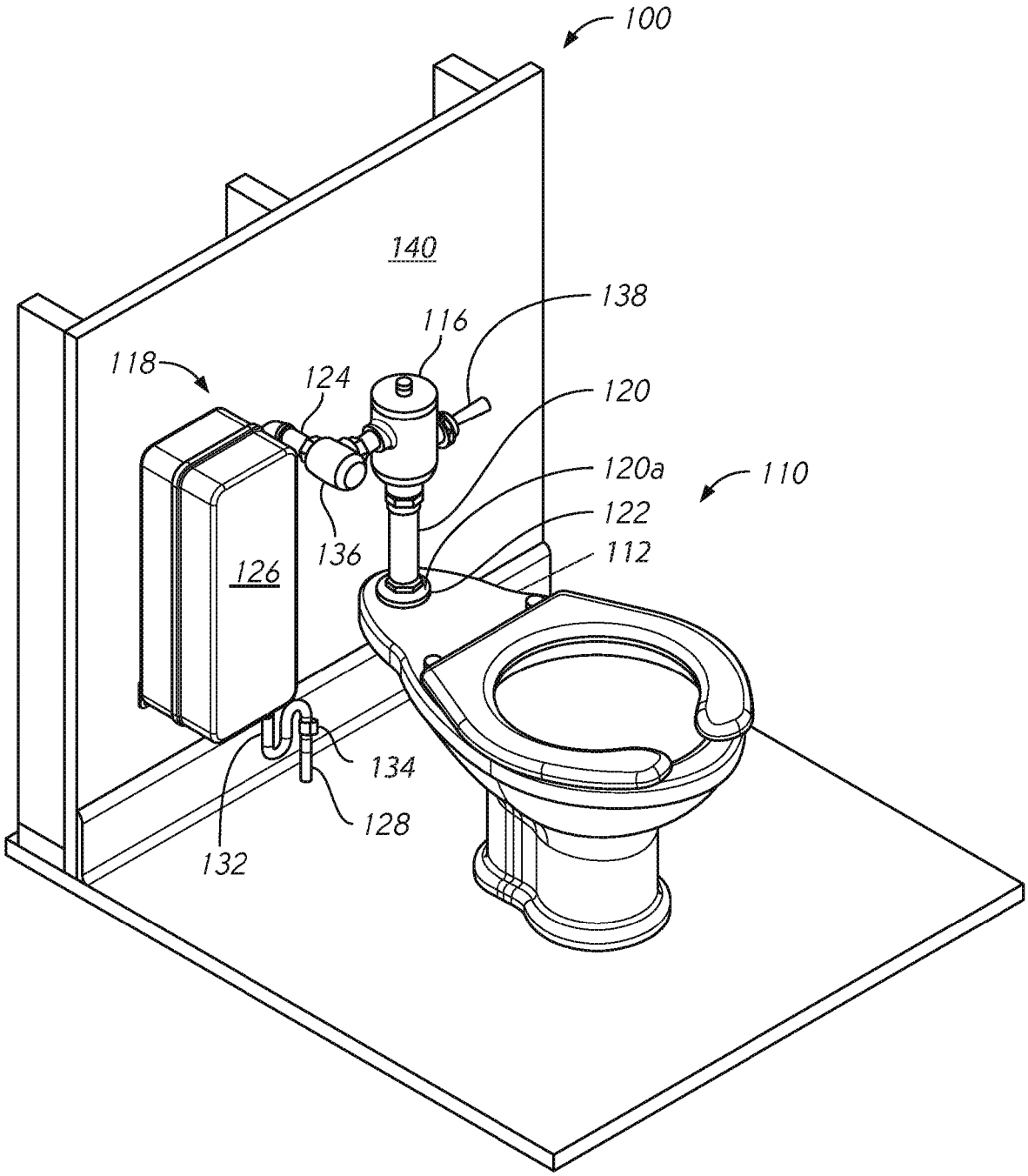
FIG. 9 is a view perspective of the embodiment of FIG. 6 as it is in a complete toilet assembly.
Figure 10:
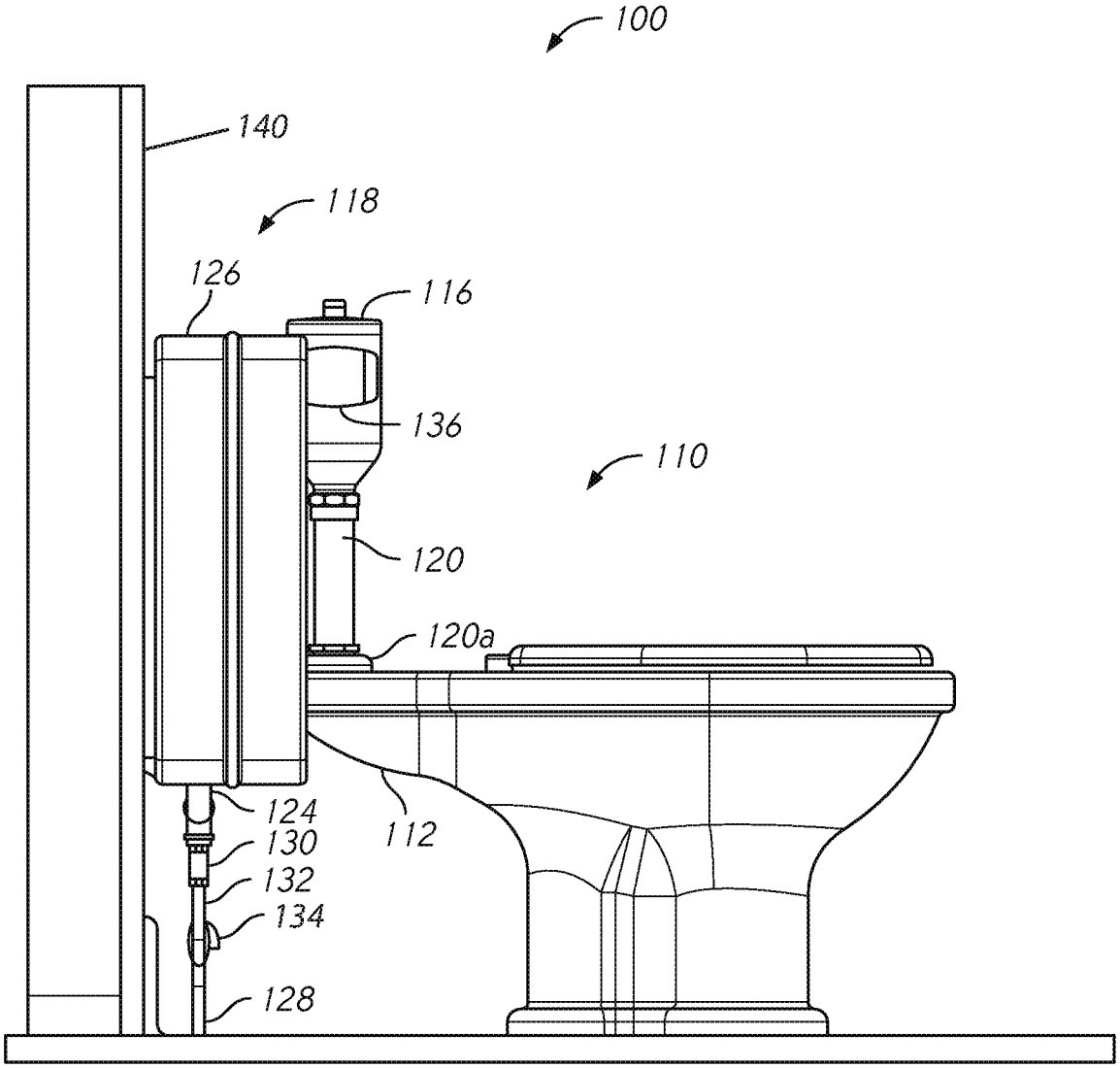
FIG. 10 is a side view of FIG. 9.
Figure 11:
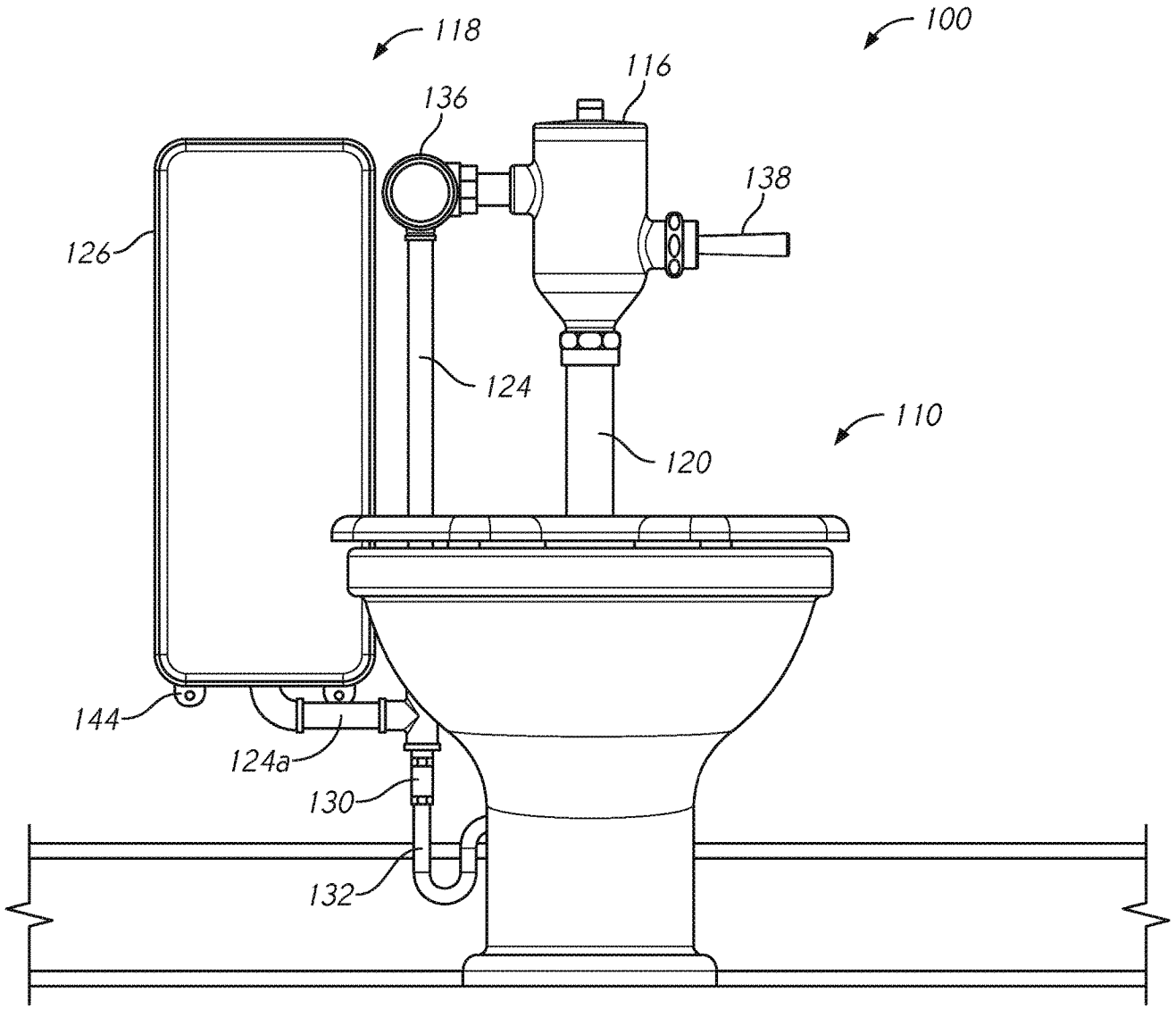
FIG. 11 is a front view of FIG. 9.
Figure 12:
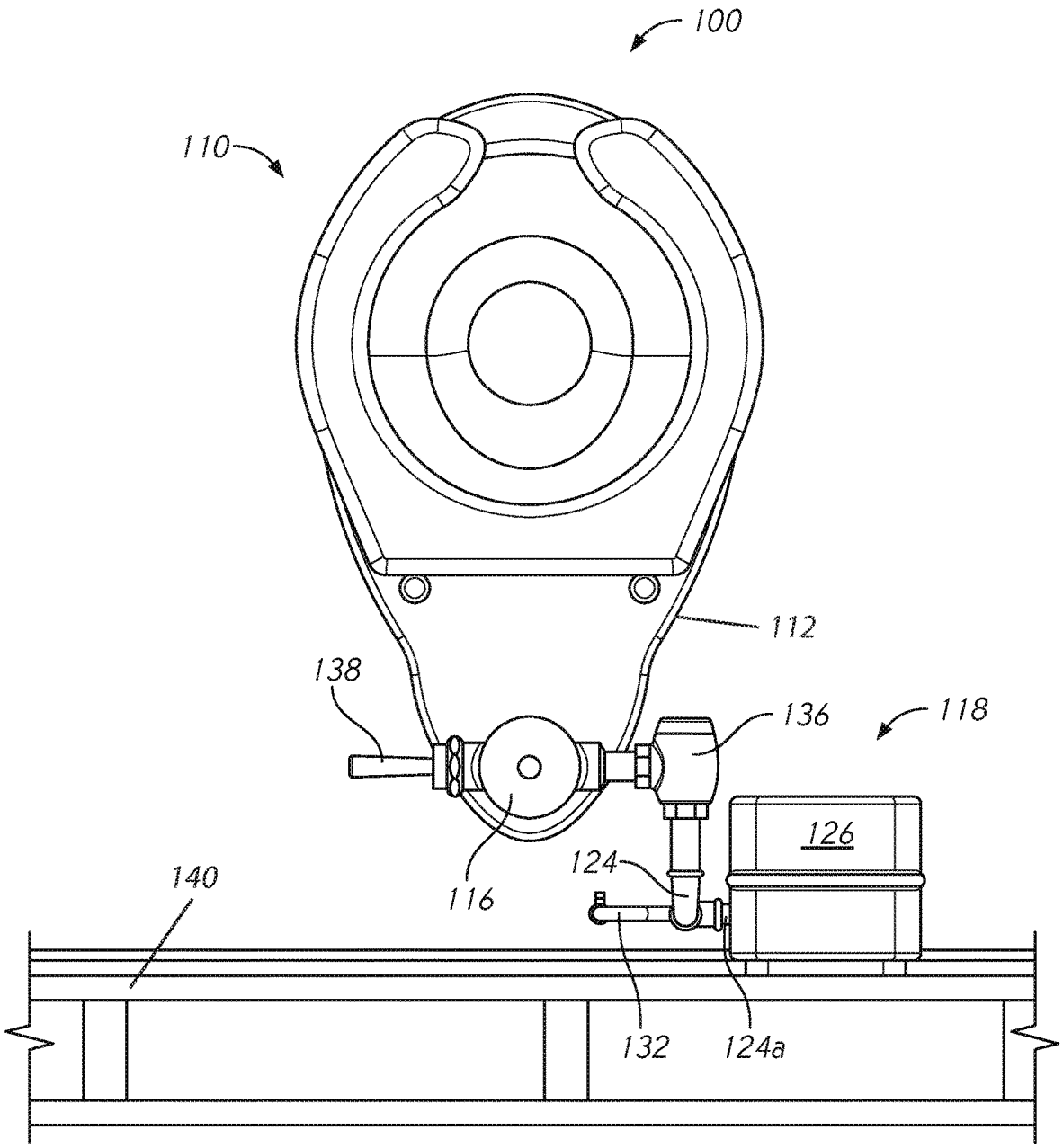
FIG. 12 is a top view of FIG. 9

FIGS. 6-12 show an alternative embodiment for wall hanging the immediate supply assembly 118. Referring to FIGS. 6-8, in this alternative embodiment, a portion of the toilet assembly is made to be hung on a wall 140 adjacent to the toilet assembly 110, now referred to as a wall attachable portion which comprises in exemplary form, the immediate supply assembly now described as a wall attachable immediate supply assembly 118 which includes a wall attachable pressurized water storage apparatus 126 in the form of a vertically elongated rectangular box and adapter piping 124. The wall attachable pressurized water storage apparatus 126 has a hanger 142 at a position on its back near its top and a set of clips 144 on its back near its bottom for the purpose of hanging it on the wall 140. Hanger 142 will match with a hanger receiver bar (not shown) on the wall to allow hanging it, and the clips 144 will be fixed by fasteners to the wall. FIGS. 9-12 illustrate the complete toilet system in which the wall attachable water storage apparatus 126 is attached to a wall 140 with the adapter piping 124 being connected to the flushometer 116 which is connected to the toilet bowl 112 all as described above. It can be understood that with the change to the wall attachable pressurized water storage apparatus 126 the elements of the complete toilet assembly 110 are as described above which includes connector piping 124*a*, check valve 130, double slip tail piece 136, source connecter of reduced size 132, residential component supply plumbing 128, shut off valve 134. In a modified embodiment of the wall attachable pressurized water storage apparatus 126 the rectangular box shape itself can be an external cover or box and the actual mechanism of the pressurized water storage apparatus can be contained in it.

Figure 13:
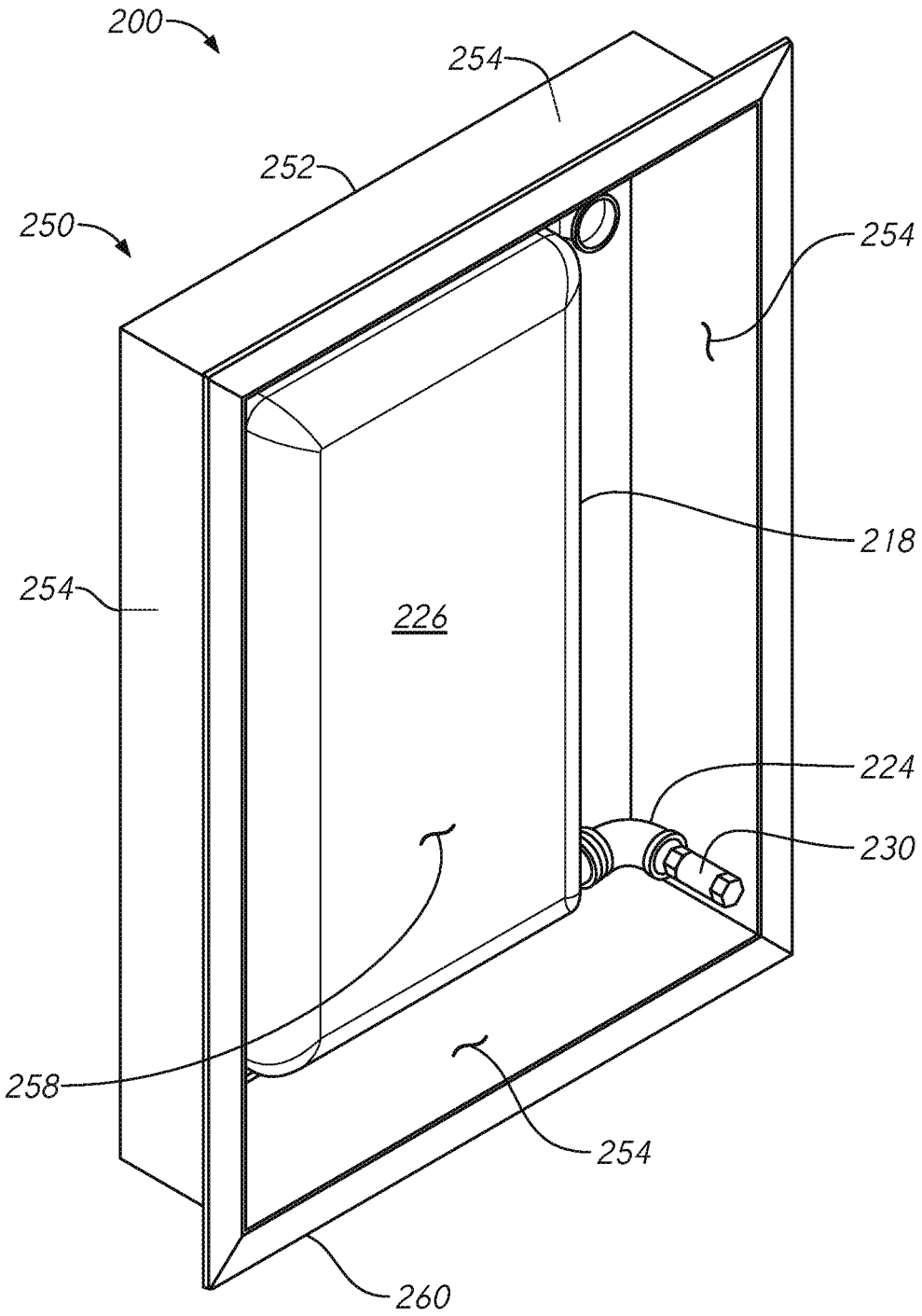
FIG. 13 is a perspective of an alternative embodiment for installation of the flushometer immediate supply assembly inside a wall.
Figure 14:
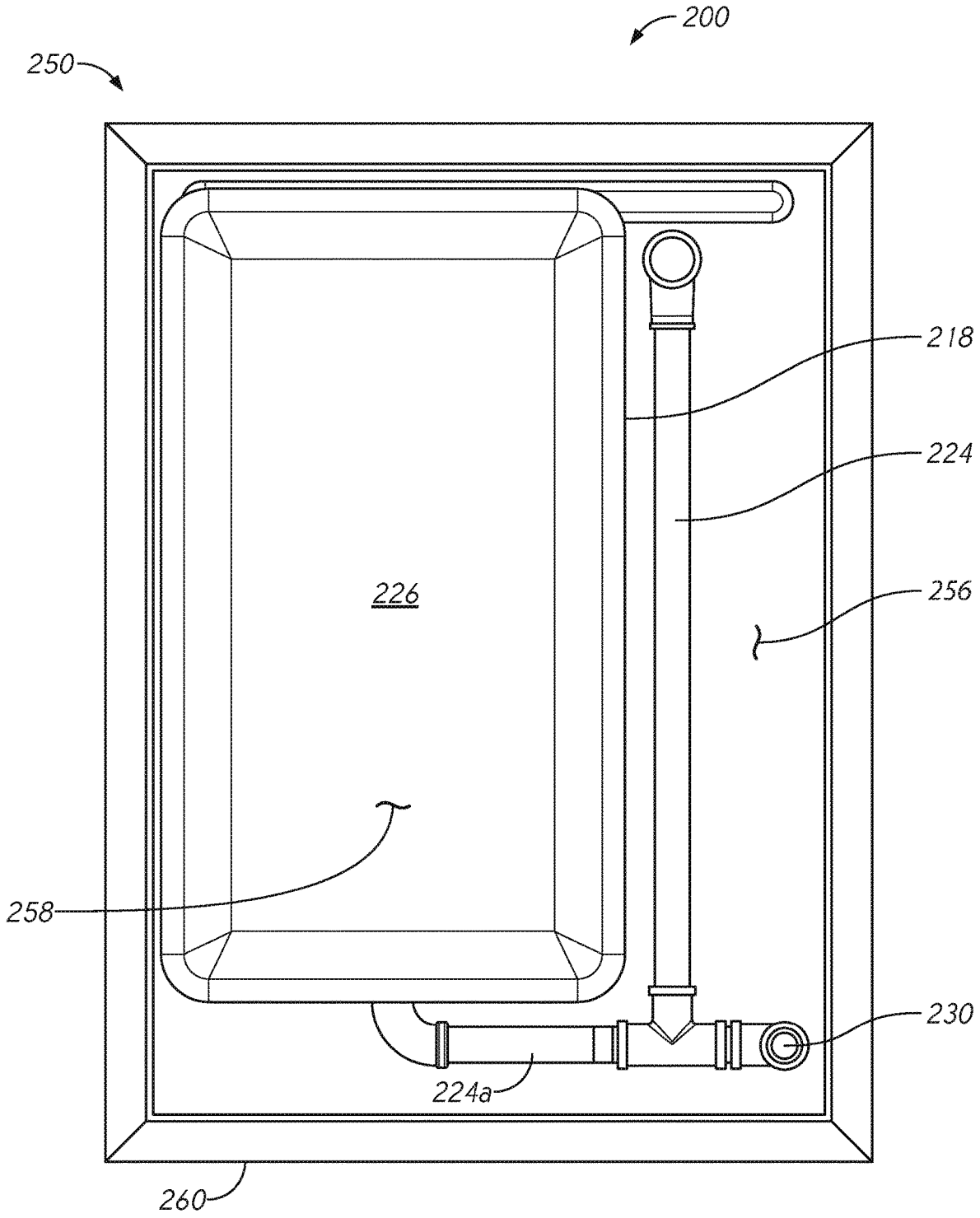
FIG. 14 is a front view of the embodiment of FIG. 13.
Figure 15:
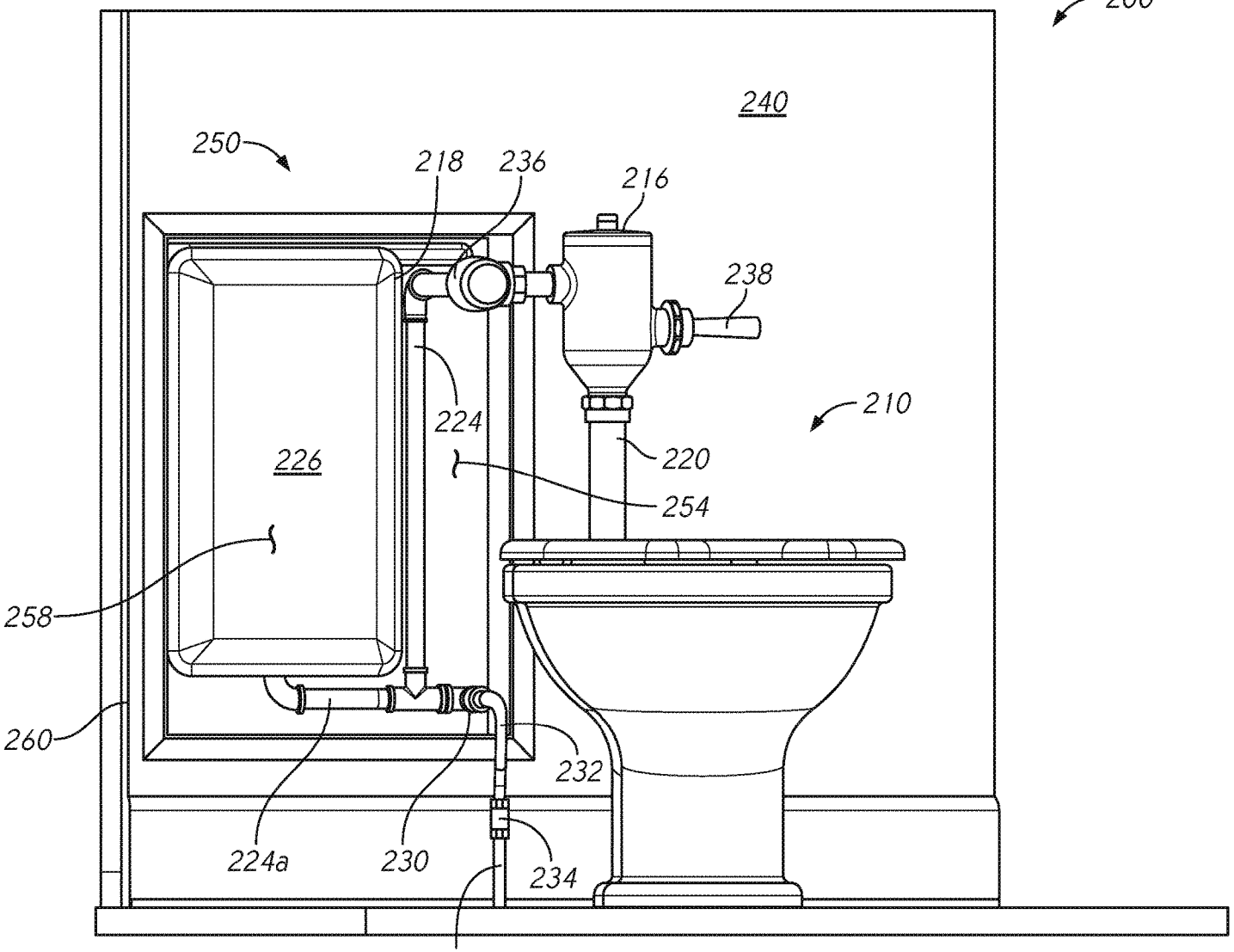
FIG. 15 is a front view of the embodiment of FIG. 13 as it is in a complete toilet assembly

FIGS. 13-18 show an alternative embodiment for installing the immediate supply assembly 218 inside a wall 240 adjacent to the toilet 212. FIGS. 13-15 show a container box assembly 250 comprising a container box unit 252 with the immediate supply assembly 218 installed inside it, that installation comprising the pressurized water storage apparatus 226 and the flush valve adapter piping 224. The check valve 230 is in the illustrated embodiment also inside the container box unit 252 although it could be extendedly connected to be outside the box unit 252. This container box unit 252 having sides (vertical and horizontal) 254 a back 256 and an open front 258. For good finishing of the wall, there is an outwardly extending frame 260 around the open front 258. The immediate supply assembly 218 is fitted into and secured in the container box unit box 252 in a manner known to persons skilled in the art.

Figure 16:
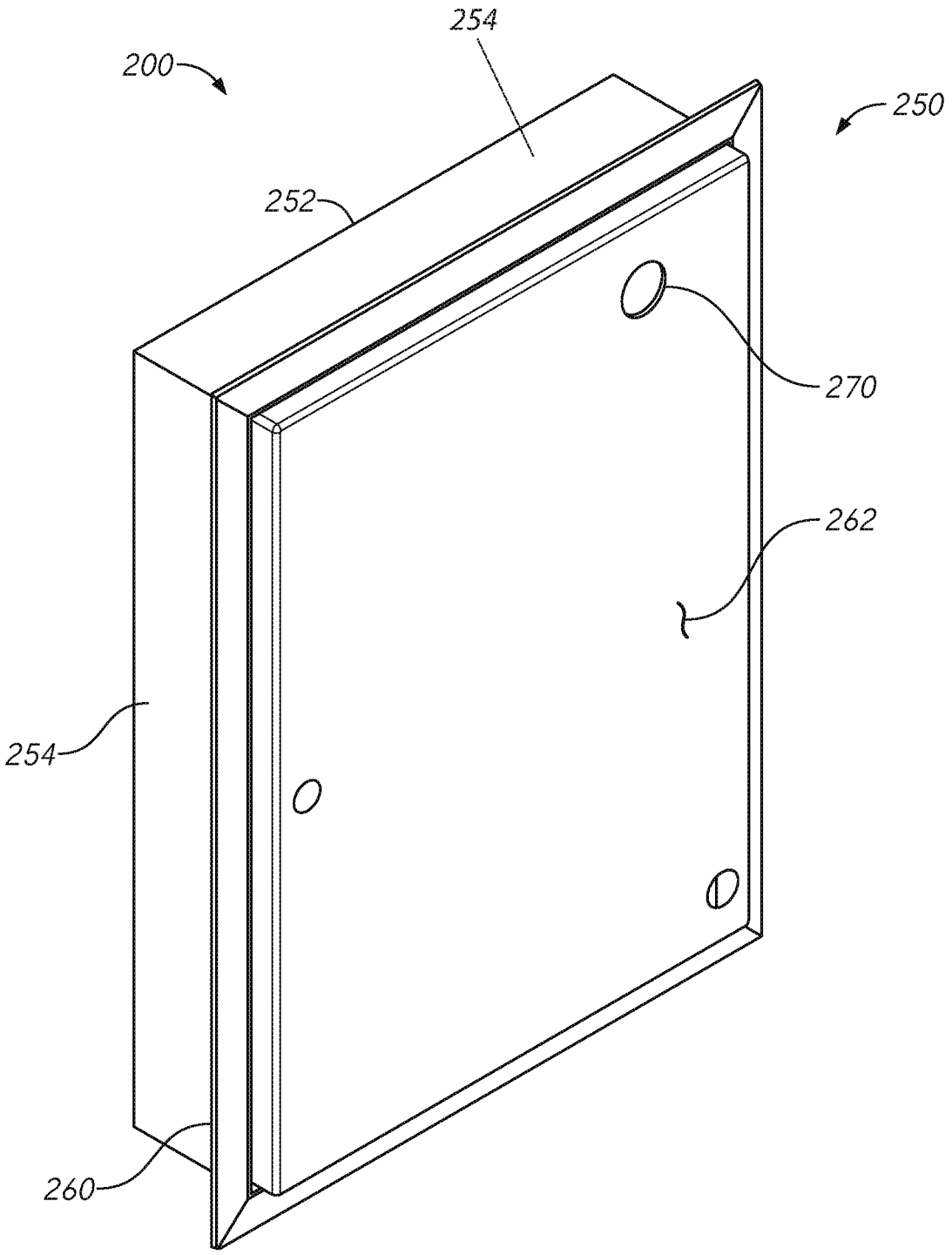
FIG. 16 is a perspective of the embodiment of FIG. 13 with a cover on the box.
Figure 17:
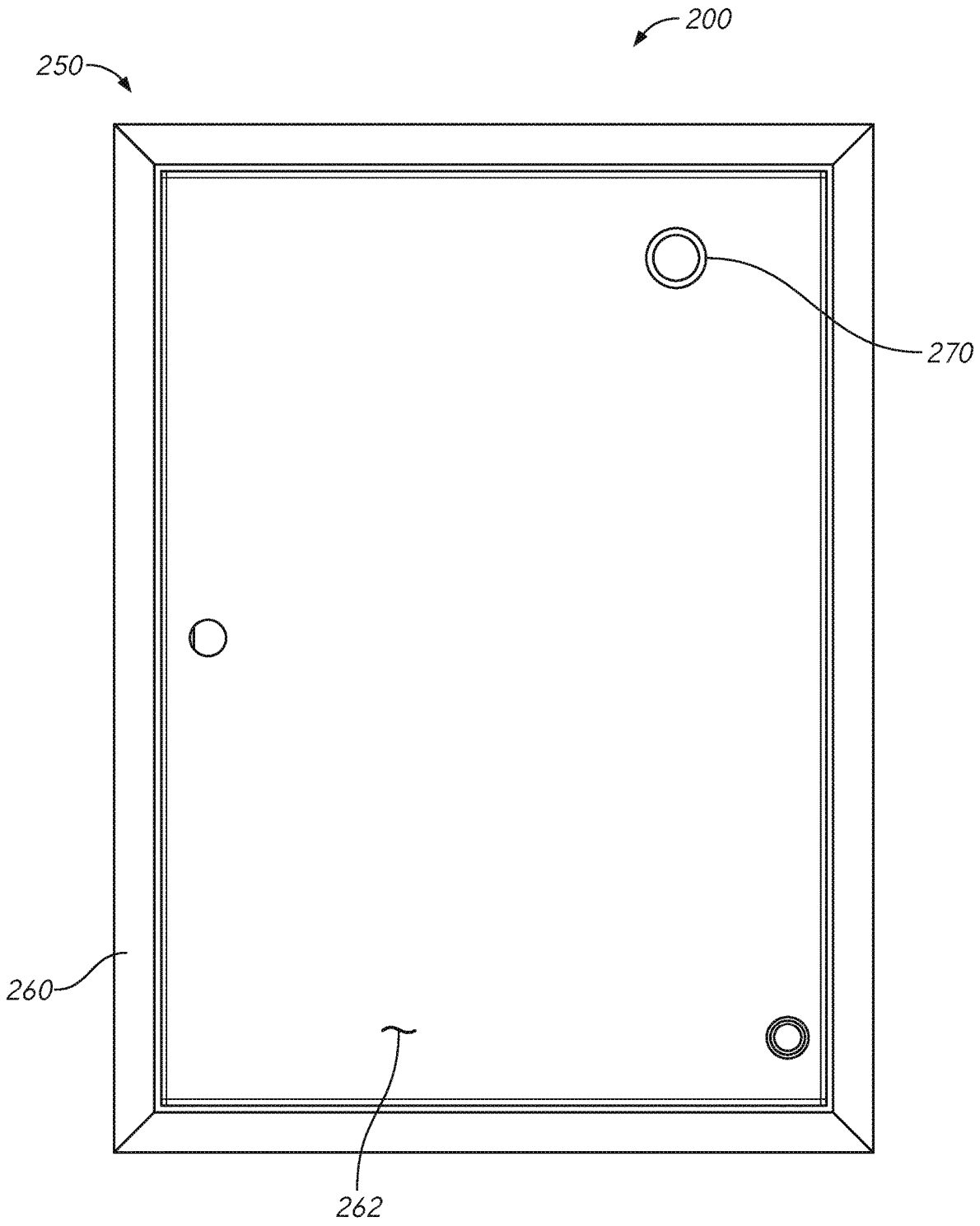
FIG. 17 is a front view of the embodiment of FIG. 16.

FIGS. 16 and 17 show as part of the container box assembly 250 having a cover 262 that is removably fastened to the container box unit 252. The cover 262 has an upper opening 270 for passing through it an extended length of the adapter piping 224 which connects to the double slip tail piece 236 (see FIG. 18). The cover 262 has a lower opening 274 for passing through it to a source connector pipe of reduced size 232 which connects past a shut off valve 234 to the residential component supply plumbing 228.

Figure 18:
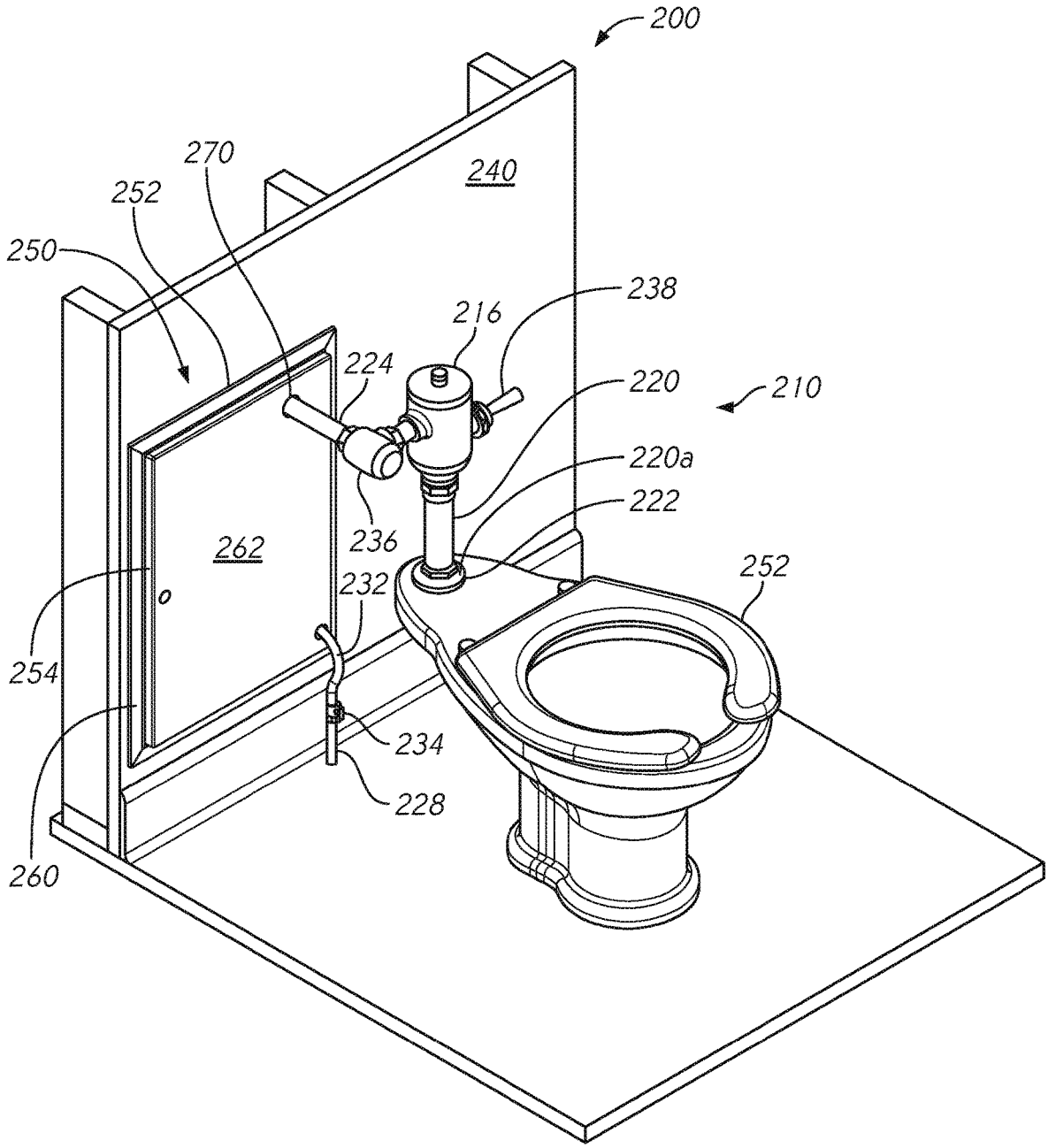
FIG. 18 is a perspective view of the embodiment of FIGS. 13 to 17 shown as in a complete toilet assembly.
Figure 19:
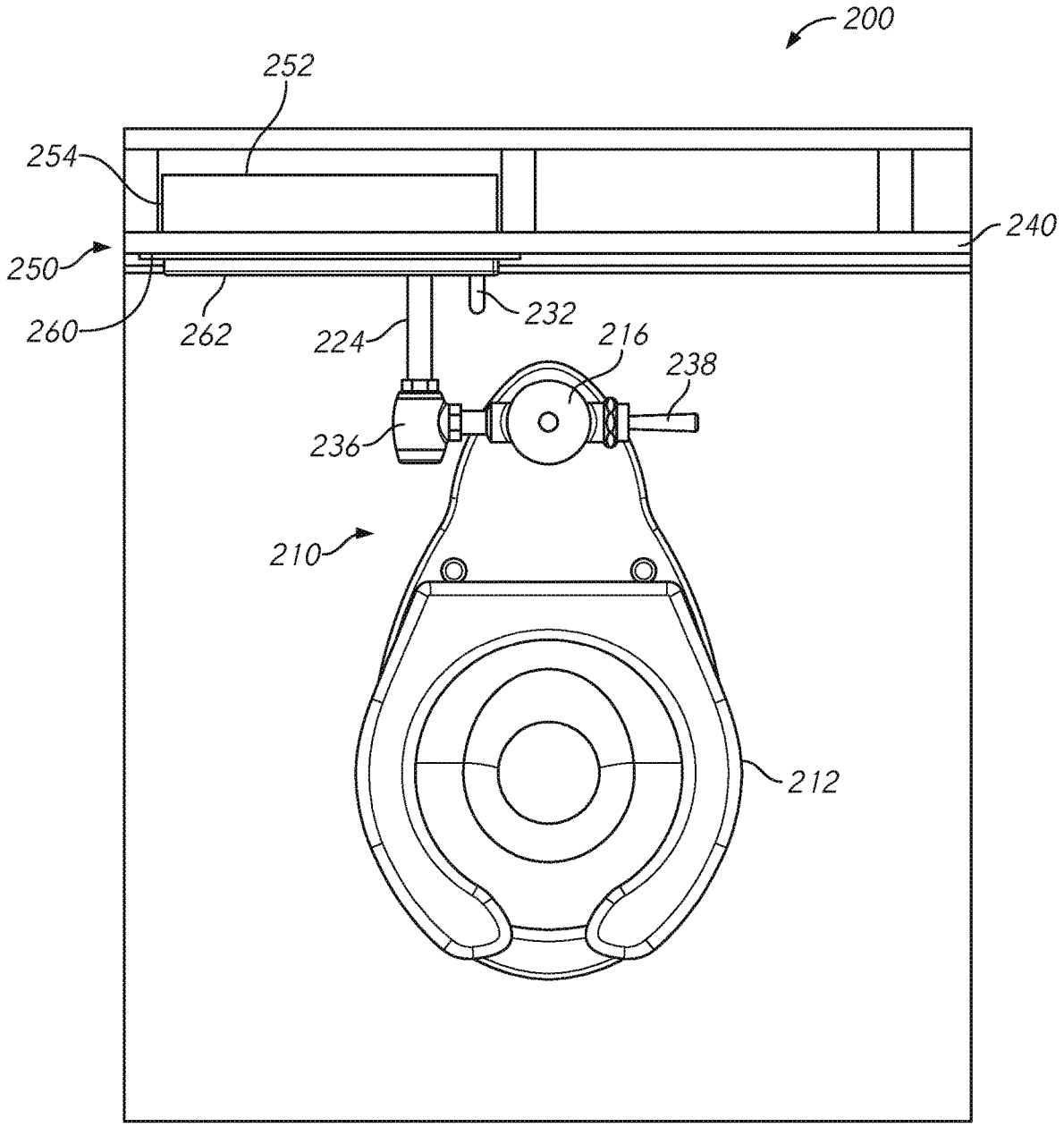
FIG. 19 is a top view of the embodiment of FIGS. 13 to 17 shown as in a complete toilet assembly.
Figure 20:
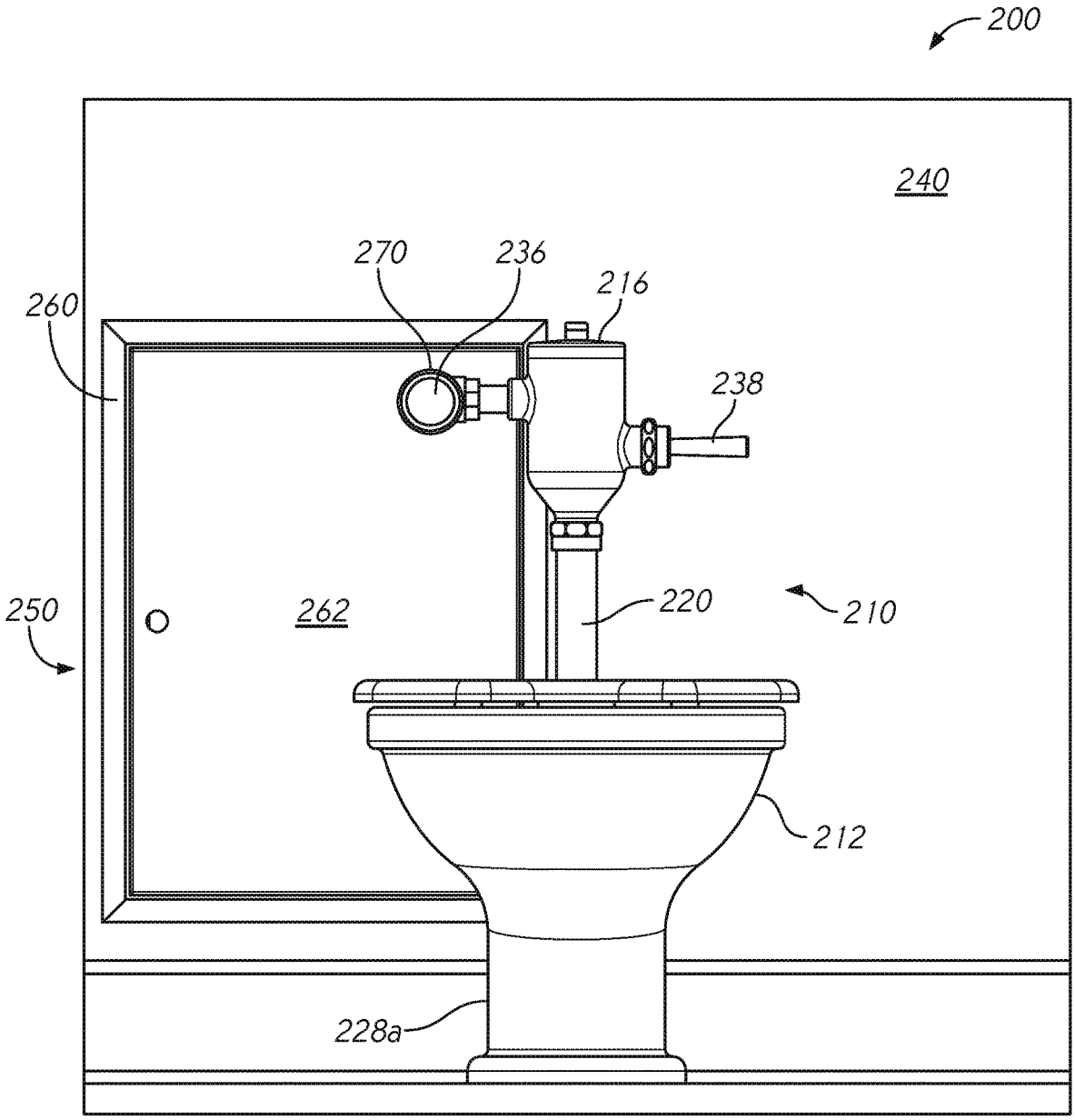
FIG. 20 is a front view of the embodiment of FIGS. 13 to 17 shown as a complete toilet assembly.

FIGS. 18 to 20 shows installation of the complete toilet assembly 210 with the above described container box assembly 250 installed inside the wall 240.

Figure 21:
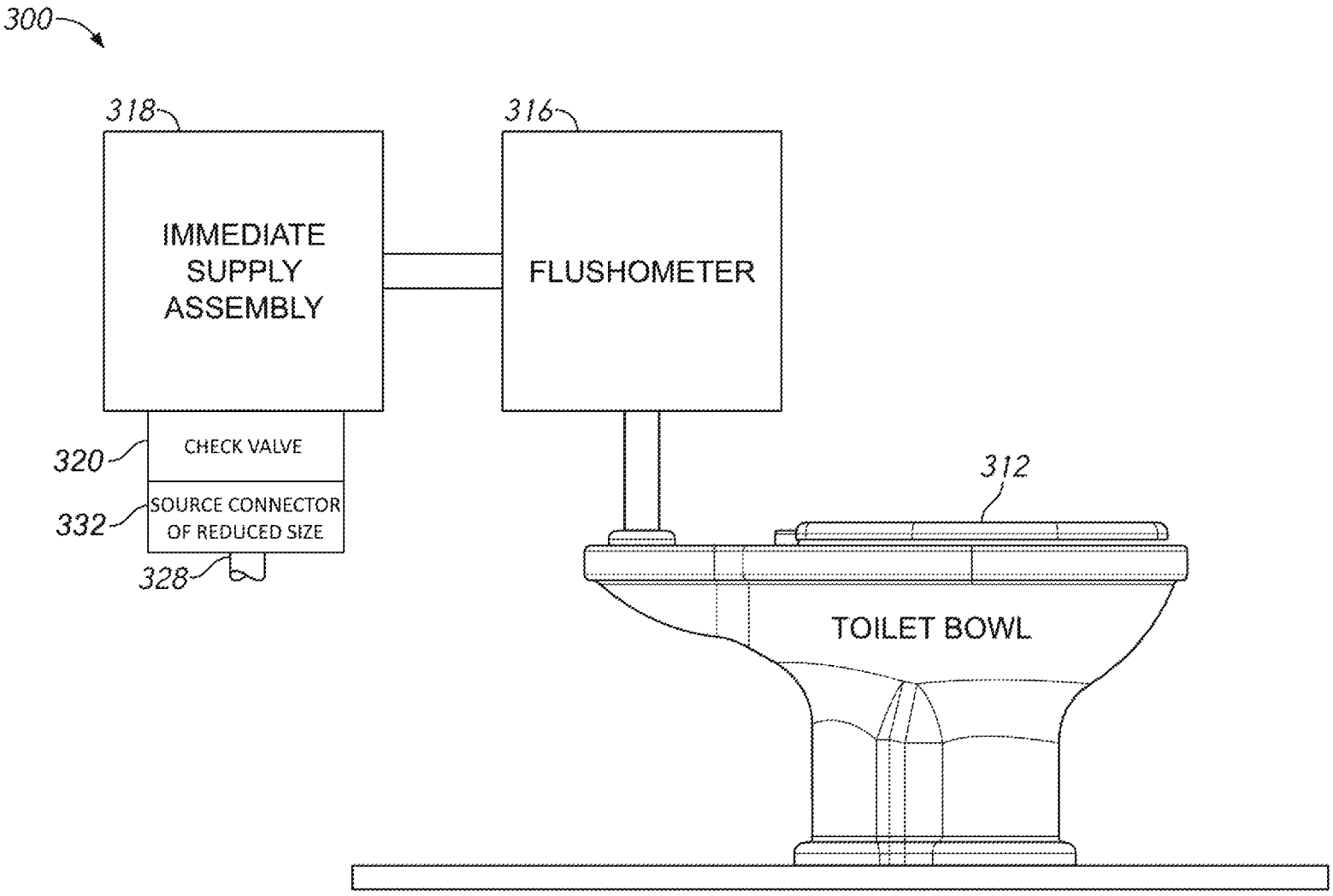
FIG. 21 is a block diagram of an embodiment.

The immediate supply assembly is described above in an embodiment having two parts, the pressurized water storage apparatus and flush valve adapter piping. However, it can be understood that the immediate supply assembly can be constructed in other embodiments providing the functional elements, which are that a supply of water is available under pressure and that the amount of water available is sufficient to pass through the flushometer and flush the toilet. Therefore, it is understood that a single structure or multiple structures can be configured to accomplish these functions. FIG. 21 shows a block schematic for such a range of configurations having an immediate supply assembly 318 connected to a flushometer 316, where the incoming water from the residential component supply plumbing 328 passes in one embodiment through a source connector of reduced size 232 and a check valve 330 and enters the immediate supply assembly 318 in a configuration as described for the embodiments described above, and the flushometer 312 flushes to the toilet 312.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A residential toilet system connected to residential component supply plumbing comprising:

a flushometer valve connected to a toilet for flushing the toilet upon activation of the flushometer valve;

a pressurized flush water immediate supply assembly connected to the flushometer valve being adapted to supply a volume of water under pressure through the flushometer valve upon activation of the flushometer valve the pressurized flush water immediate supply assembly comprising:

a flush water adapter piping connected for receiving flow of water from the residential component supply plumbing and being of a larger diameter than the residential component supply plumbing and being connected for water flow to an inlet of the flushometer valve; and a pressurized water storage apparatus connected for pressurized flow of additional water to the flush water adapter piping;

wherein the pressurized flush water immediate supply assembly is full and under pressure at a ready to flush condition and upon flushing operation of the flushometer valve releases its stored and pressurized water volume through the flushometer valve to effect flushing of the toilet and after the flushing upon opening of a check valve is recharged by water flow from the residential component supply plumbing into the pressurized flush water immediate supply assembly; and further comprising a check valve having an entry and an exit and the entry connected to the residential component supply plumbing and the exit connected to the pressurized flush water immediate supply assembly and having an opening and closing pressure specification so as to open upon a pressure drop when a flush is in process by operation of the flushometer valve thereby to recharge the pressurized flush water immediate supply assembly and so as to close when the recharging has reached a specified closing pressure to provide a ready to flush condition.

2. The residential toilet system of claim 1 further comprising a toilet.

3. The residential toilet system of claim 1 wherein the pressurized water storage apparatus is an accumulator tank.

4. The residential toilet system of claim 1 wherein the flush water adapter piping of a larger diameter is no more than twenty inches from the flushometer.

5. The residential toilet system of claim 1 wherein the pressurized water storage apparatus provides a water volume of about 3.7 to 6 liters.

6. The residential toilet system of claim 5 wherein the pressurized water storage apparatus provides a water volume of about 3.8 to 5 liters.

7. The residential toilet system of claim 5 wherein the pressurized water storage apparatus holds a water volume of about 5 liters.

8. The residential toilet system of claim 1 wherein the pressurized flush water immediate supply assembly provides a water volume up to about 8 liters.

9. The residential toilet system of claim 1 further comprising a portion of reduced size piping relative to and from the residential component supply plumbing and connected to the entry to the check valve.

10. The residential toilet system of claim 1 wherein the pressurized flush water immediate supply assembly has a pressure at a ready to flush condition determined by the pressure from the residential component supply plumbing.

11. The residential toilet system of claim 1 wherein the pressurized flush water immediate supply assembly provides a water volume of about 3.5 to 8 liters.

12. The residential toilet system of claim 1 wherein the pressurized flush water immediate supply assembly provides a pressure at the ready to flush condition of about 25 to 80 psi.

13. The residential toilet system of claim 1 wherein the flushometer executes at each flush a water volume selected from the group consisting of:

nominally 1.6 gallons per flush, nominally 1.28 gallons per flush, nominally 1.06 gallons per flush, and nominally 1 gallon per flush.

14. A toilet flushing system for attaching a flushometer valve to a residential component supply plumbing for mitigating upstream hydraulic effects comprising:

a flushometer valve connected for flushing a toilet;

a pressurized flush water immediate supply assembly connected for water flow through the flushometer valve upon a flushing activation of the flushometer valve; and a check valve connected between the residential component supply plumbing and the pressurized flush water immediate supple assembly, the check valve having operating specification to be closed when the pressurized flush water immediate supply assembly is in a ready to flush condition and to open during a flushing cycle by activation of the flushometer valve and to close when the pressurized flush water immediate supply assembly has been recharged to the ready to flush condition.

15. A method of altering a residential toilet flushing means of the type having a water closet tank holding water for flushing, to achieve better flushing comprising:

providing access to the toilet for flushing;

attaching a check valve to a residential component water supply source;

connecting the check valve to a pressurized flush water immediate supply assembly;

attaching the pressurized flush water immediate supply assembly to an input of a flushometer valve having an output; and attaching the flushometer valve output to the toilet;

wherein upon operating the flushometer valve, water stored in the flush water immediate supply passes through the flushometer and flushes the toilet; and wherein the check valve is in a closed condition when the pressurized flush water immediate supply assembly is charged with water defining a pressurized ready to flush status; and wherein upon operating the flushometer valve, pressure at an outlet of the check valve reduces to a status as to cause the check valve to open for the flow of water from the residential supply source to recharge the pressurized flush water immediate supply assembly to the pressurized ready to flush status.

16. The method of claim 15 wherein the flush water immediate supply assembly comprises:

a flush water adapter piping being of a larger diameter than residential component supply plumbing from which water is supplied and being attached to the flushometer valve; and a pressurized water storage apparatus openly connected for water flow to the flush water adapter piping; and wherein pressurized water storage apparatus and the flush water adapter piping are commonly connected for receiving flow of water from the residential component supply plumbing.

17. The method of claim 15 wherein the pressurized water storage apparatus is an accumulator tank.

18. The method of claim 15 wherein the pressurized water storage apparatus provides a water volume of about 3.5 to 8 liters.

19. The method of claim 18 wherein the pressurized water storage apparatus provides a water volume of about 3.7 to 6 liters.

20. The method of claim 19 wherein the pressurized water storage apparatus provides a water volume of about 3.8 to 5 liters.

21. The method of claim 15 having condition in which the pressurized flush water immediate supply assembly is in a ready-to-flush condition at which the check valve is closed and having a flushing operation of the flushometer valve which then allows the check valve to open whereby water from the residential water supply will refill and re-pressurize the pressurized flush water immediate supply assembly.

22. An improved home toilet flushing system connected to residential component water supply plumbing that utilizes a flushometer valve providing sufficient volume of water and pressure of water to allow operation of the flushometer valve for flushing a toilet and which system will minimize pressure drop on nearby plumbing components from sudden lowering of pressure in the residential component water supply plumbing near the flushing system upon operation of the flushometer valve comprising:

a toilet having an inlet for receiving flush water from a flushometer valve;

a flushometer valve connected to the toilet for running flush water from the flushometer valve to the toilet thereby to flush the toilet;

a flush-water immediate supply assembly connected to an inlet of the flushometer valve adapted to supply water under pressure to the flushometer valve for flushing;

a check valve connected between residential component supply plumbing and the pressurized flush water immediate supply assembly; and connected intermediately between the check valve and the residential component supply plumbing a source connector of reduced size relative to the size of the residential component supply plumbing;

the check valve having a closed condition when the pressurized flush water immediate supply assembly is in a fully pressurized static condition preparatory to flushing and having an open condition when flushing has reduced pressure in the pressurized flush water immediate supply assembly below that specified for the check valve to open wherein the pressurized flush water immediate supply assembly will be returned to a ready to flush status.

* * * * *